US012566040B2

(12) United States Patent
Dawson, Jr. et al.

(10) Patent No.: US 12,566,040 B2
(45) Date of Patent: Mar. 3, 2026

(54) FIREARM

(71) Applicant: STACCATO 2011, LLC, Georgetown, TX (US)

(72) Inventors: David J. Dawson, Jr., Florence, TX (US); Dustin Turner, Georgetown, TX (US); Jeffery Hildner, Belton, TX (US); Christopher Schirmer, Georgetown, TX (US); Paul Smith, Bozeman, MT (US); Nathan Horvath, Austin, TX (US); Anthony Clark, II, Round Rock, TX (US); Cullen Fravel, Killeen, TX (US)

(73) Assignee: Staccato 2011, LLC, Florence, TX (US)

( * ) Notice: Subject to any disclaimer, the term of this patent is extended or adjusted under 35 U.S.C. 154(b) by 0 days.

(21) Appl. No.: 18/492,352

(22) Filed: Oct. 23, 2023

(65) Prior Publication Data

US 2024/0133653 A1 Apr. 25, 2024
US 2024/0230269 A9 Jul. 11, 2024

Related U.S. Application Data

(60) Provisional application No. 63/418,839, filed on Oct. 24, 2022.

(51) Int. Cl.

| | |
|---|---|
| ***F41A 3/66*** | (2006.01) |
| ***F41A 21/24*** | (2006.01) |
| ***F41A 29/04*** | (2006.01) |

(52) U.S. Cl.
CPC ..... *F41A 29/04* (2013.01); *F41A 3/66* (2013.01); *F41A 21/24* (2013.01)

(58) Field of Classification Search
CPC ..... F41A 29/04
See application file for complete search history.

(56) References Cited

U.S. PATENT DOCUMENTS

| | | | |
|---|---|---|---|
| 1,738,751 | A | 12/1929 | Bluehdorn |
| 2,115,041 | A | 4/1938 | Alejandro |
| 2,464,010 | A | 3/1949 | Vonella |

(Continued)

FOREIGN PATENT DOCUMENTS

| | | |
|---|---|---|
| EM | 015019000-0001 | 5/2023 |
| EM | 015019000-0002 | 5/2023 |

(Continued)

OTHER PUBLICATIONS

1911addicts.com [online], "Flat vs Curved," available on or before Mar. 3, 2019, retrieved on Aug. 24, 2023, retrieved from URL<https://www.1911addicts.com/threads/flat-vs-curved.66283/>, 11 pages.

(Continued)

*Primary Examiner* — Derrick R Morgan
(74) *Attorney, Agent, or Firm* — Jackson Walker L.L.P.

(57) ABSTRACT

A firearm with a slide and a frame. The slide has a slide rail. The frame has a frame rail. The frame rail interfaces with the slide rail. The frame rail has a lubrication groove and a debris removal port. The lubrication groove extends along a surface of the frame rail that bears against the slide rail during operation of the firearm. The debris removal port has gap within the frame rail proximate to an end of the lubrication groove.

19 Claims, 26 Drawing Sheets

(56) References Cited

U.S. PATENT DOCUMENTS 2,489,816 A 11/1949 Reilly
2,943,412 A 7/1960 McNally
3,207,037 A 9/1965 Pachmayr et al.
3,411,408 A 11/1968 Pachmayr et al.
3,564,967 A 2/1971 Violette et al.
3,745,881 A 7/1973 Roy
4,222,308 A 9/1980 Arnett
4,463,655 A * 8/1984 Krieger ..... F41C 27/00 89/196
4,575,963 A 3/1986 Ruger et al.
4,602,450 A 7/1986 Hoenig
D285,235 S 8/1986 Cellini
D292,112 S 9/1987 Ruger et al.
4,707,942 A 11/1987 Peters
D293,357 S 12/1987 Ruger et al.
4,907,489 A 3/1990 Teague
4,916,843 A * 4/1990 Beretta ..... F41A 3/68 89/196
4,976,184 A 12/1990 Bunczk
4,996,787 A 3/1991 Holcomb et al.
D316,587 S 4/1991 Sanford
5,024,016 A 6/1991 Smith
5,033,217 A * 7/1991 Brennan ..... F41A 19/01 42/1.01
5,042,185 A 8/1991 Justice
5,267,407 A 12/1993 Bornancini
D345,002 S 3/1994 Strayer et al.
5,433,134 A 7/1995 Leiter
D365,103 S 12/1995 Iacobellis
5,585,589 A 12/1996 Leiter
5,753,848 A 5/1998 Kart
5,969,285 A 10/1999 Krebs
D416,013 S 11/1999 Muraki et al.
6,212,991 B1 4/2001 Frazier, III
D444,786 S 7/2001 Otomi et al.
6,283,006 B1 9/2001 Szabo et al.
6,298,594 B1 10/2001 Strayer
6,318,231 B1 11/2001 Kart
6,374,526 B1 4/2002 Mochak
6,401,379 B1 * 6/2002 Moon ..... F41C 23/18 42/71.01
D479,570 S 9/2003 Scheunert
6,718,680 B2 * 4/2004 Roca ..... F41A 17/46 89/184
D503,207 S 3/2005 Salva
6,860,053 B2 3/2005 Christiansen
D505,476 S 5/2005 McGarry
D560,750 S 1/2008 Potter
D562,931 S 2/2008 Szabo
D570,925 S 6/2008 Wu
D579,072 S 10/2008 McGarry
D593,629 S 6/2009 Bantle et al.
D594,924 S 6/2009 Pflaumer et al.
D599,430 S 9/2009 Siddle et al.
8,087,344 B2 1/2012 Siddle et al.
D655,365 S 3/2012 Karfiol et al.
8,132,352 B2 * 3/2012 Lippard ..... F41A 17/56 42/1.06
D661,766 S 6/2012 Siddle et al.
D661,767 S 6/2012 Siddle et al.
D681,131 S 4/2013 Su
D687,506 S 8/2013 Yigit
D688,764 S 8/2013 Yigit
8,528,243 B1 9/2013 Glock
8,584,390 B1 11/2013 Fraher et al.
D700,267 S 2/2014 Barfoot et al.
D702,308 S 4/2014 Glock
D716,396 S 10/2014 Rothmann
D716,397 S 10/2014 Rothmann
D716,398 S 10/2014 Barnett
D716,399 S 10/2014 Barnett
D720,423 S 12/2014 Barfoot et al.
9,057,573 B1 6/2015 Cockerham et al.
9,103,624 B1 8/2015 Kung et al.
9,310,160 B1 * 4/2016 DiChario ..... F41C 23/10
D772,364 S 11/2016 Kedairy
D777,872 S 1/2017 Wolf
D794,739 S 8/2017 Kedairy
D803,343 S 11/2017 Novak et al.
D815,233 S 4/2018 Toner et al.
D823,969 S 7/2018 Beville et al.
10,018,434 B2 * 7/2018 Daley, Jr. ..... F41A 3/66
10,184,736 B2 * 1/2019 Fumia ..... F41A 5/02
D839,971 S 2/2019 Chu
D846,038 S 4/2019 Lin
D859,565 S 9/2019 Oglesby
10,415,905 B2 * 9/2019 Bubits ..... F41A 3/14
D865,897 S 11/2019 Reese et al.
D868,923 S 12/2019 Toner et al.
D870,228 S 12/2019 Jager
D879,233 S 3/2020 Wallgren
D883,413 S 5/2020 Wilson et al.
D890,286 S 7/2020 Huang
10,760,861 B2 9/2020 Williams
D904,544 S 12/2020 Bassam Meqdad
10,969,188 B1 4/2021 Cottingham
10,976,127 B2 4/2021 Adika
10,982,917 B1 * 4/2021 Schober ..... F41A 3/66
11,313,646 B1 * 4/2022 Simon ..... F41G 1/16
D951,385 S 5/2022 Enright
11,320,234 B1 5/2022 Simon
D965,727 S 10/2022 Ribic et al.
11,624,571 B1 4/2023 Kim et al.
2002/0096042 A1 7/2002 Adkins
2004/0007124 A1 * 1/2004 Nakatani ..... F41A 25/24 89/196
2004/0200466 A1 10/2004 Salva
2006/0150466 A1 7/2006 Hochstrate et al.
2007/0199227 A1 8/2007 Ertl
2009/0071053 A1 * 3/2009 Thomele ..... F41A 11/02 42/70.08
2011/0041375 A1 2/2011 Siddle et al.
2012/0023801 A1 2/2012 Rozum et al.
2013/0036644 A1 * 2/2013 Bardy ..... F41A 3/64 42/69.01
2013/0108991 A1 5/2013 Walls
2013/0133235 A1 * 5/2013 Lippard ..... F41A 29/04 42/14
2014/0047753 A1 2/2014 Grossman et al.
2016/0047613 A1 * 2/2016 Hudson, III ..... F41A 19/10 42/14
2016/0109207 A1 4/2016 Buchel et al.
2016/0377365 A1 12/2016 Lee
2017/0205163 A1 * 7/2017 Fumia ..... F41A 5/02
2017/0299315 A1 10/2017 Shelton et al.
2018/0058792 A1 3/2018 Schirmer et al.
2018/0066907 A1 3/2018 Hefer et al.
2018/0106566 A1 * 4/2018 Hudson, III ..... F41A 35/00
2019/0154369 A1 * 5/2019 Kim ..... F41A 3/66
2019/0226777 A1 7/2019 Williams
2019/0360775 A1 11/2019 Kung et al.
2020/0200508 A1 6/2020 Teetzel et al.
2024/0219132 A1 * 7/2024 Homan ..... F41A 3/66

FOREIGN PATENT DOCUMENTS

EM 015019000-0003 5/2023
EP 3869141 8/2021

OTHER PUBLICATIONS a-airsoft.com [online], "Edge Custom "T2" Aluminum Trigger for Hi-CAPA/1911," available on or before Jan. 26, 2020, via Internet Archive: Wayback Machine URL <https://web.archive.org/web/20200126210449/http://www.a-airsoft.com/index.php?route=product/product&product_id=1414>, 3 pages.

arnzenarms.com [online], "Atlas Hyperion 3 Gun V2 2011," available no later than Oct. 24, 2022, retrieved on Jan. 19, 2024, retrieved from URL <https://arnzenarms.com/product/atlas-gunworks/2011/limited/uspsa/competition/hyperion-3-gun-v2-2011-9x19mm-46-

(56) References Cited

OTHER PUBLICATIONS barrel-hard-chrome-frame-slide-dlc-grip-controls-railed-frame-atlas-0>, 2 pages.
bevfitchett.us [online], "Fluted chamber," Apr. 3, 2022, retrieved on Aug. 24, 2023, retrieved from URL <https://www.bevfitchett.us/ballistics/fluted-chamber.html>, 1 page.
colt1911.eu [online], "Match Trigger, black, "triangle" with screw for trigger stop!," available no later than Oct. 24, 2022, retrieved on Aug. 24, 2023, retrieved from URL <https://colt1911.eu/Match-Trigger-black-triangle-with-screw-for-trigger-stop>, 2 pages.
Handgunmags.com [online] "Walther PPK/S Review," Handguns, Oct. 10, 2019, retrieved on Aug. 24, 2023, retrieved from URL <https://www.handgunsmag.com/editorial/walther-ppks-review/368554>, 12 pages.
longriflesinc.com [online], "Gunsmithing Services: Barrel Fluting," Dec. 29, 2021, retrieved on Jan. 19, 2024, retrieved from URL <https://www.longriflesinc.com/products/gunsmithing-services-barrel-fluting>, 20 pages.
salientarmsinternational.com [online], "Angel Custom CNC Aluminum Fluted Outer Barrel Kit for Elite Force 1911 Series Airsoft GBB Pistols (Color: Black)," available no later than Oct. 24, 2022, retrieved on Aug. 24, 2023, retrieved from URL <http://www.salientarmsinternational.com/product/proshop/84751/>, 1 page.
PewPewTactical.com [online], "Staccato CS Review: Best Compact 2011 for Carry?" Nov. 17, 2022, retrieved Jan. 23, 2024, retrieved from URL<https://www.pewpewtactical.com/staccato-cs-review/>, 17 pages.
Staccato2011.com [online], "Introducing . . . the Staccato CS.Pure Staccato, Just Smaller," Oct. 27, 2022, retrieved Jan. 23, 2024, <https://www.instagram.com/p/CkO6K6PAqk8/?hl-en>, 1 page.

* cited by examiner

Test TX 36056

| Test 1 - Raw Barrel - No Flutes and No Coating | | Test 2 - Flutes no coating | | Test 3 - Fluted and DLC Coated | |
|---|---|---|---|---|---|
| 200 Rounds Blazer 115 FMJ | | 200 Rounds Blazer 115 FMJ | | 200 Rounds Blazer 115 FMJ | |
| Time | 1.55 | Time | 1.39 | Time | 2.39 |
| Baseline Measurements on Frame Rail | | Baseline Measurements on Frame Rail | | Baseline Measurements on Frame Rail | |
| Rear: | 0.75305 | Rear: | 0.7534 | Rear: | 0.7544 |
| Front: | 0.7536 | Front: | 0.7542 | Front: | 0.7543 |
| Temperatures After 200 Rounds | | Temperatures After 200 Rounds | | Temperatures After 200 Rounds | |
| Chamber area on barrel: | 151.7 | Chamber area on barrel: | 148.1 | Chamber area on barrel: | 209.43 |
| Slide muzzle area: | 196.7 | Slide muzzle area: | 203.9 | Slide muzzle area: | 175.1 |
| Frame port side front of slidestop: | 111.2 | Frame port side front of slidestop: | 109.4 | Frame port side front of slidestop: | 94.5 |
| Frame non port side front of slidestop: | 131 | Frame non port side front of slidestop: | 112.1 | Frame non port side front of slidestop: | 100.4 |
| Measurements while hot | | Measurements while hot | | Measurements while hot | |
| Rear: | 0.7537 | Rear: | 0.7539 | Rear: | 0.7539 |
| Front: | 0.75475 | Front: | 0.7547 | Front: | 0.7547 |

FIG. 6A

Test TX 36056

Variations

Test 2 - Varation from Raw to Fluted

| | | |
|---|---|---|
| Rear Frame | 0.0002 | Expansion |
| Front Frame | -0.0001 | Expansion |
| Chamber area on barrel: | -3.6 | No Change |
| Slide muzzle area: | 7.2 | Reduced Temp |
| Frame port side front of slidestop: | -1.8 | Increased Temp |
| Frame non port side front of slidestop: | -18.9 | Reduced Temp |

Test 3 - Varation from Fluted to Fluted and Coated

| | | |
|---|---|---|
| Rear Frame | -0.000050 | Expansion |
| Front Frame | 0.000000 | Expansion |
| Chamber area on barrel: | 61.33 | Reduced Temp |
| Slide muzzle area: | -28.8 | Increased Temp |
| Frame port side front of slidestop: | -14.9 | Increased Temp |
| Frame non port side front of slidestop: | -11.7 | Reduced Temp |

Overal Imrprovements from Test 1 to Test 3

| | | |
|---|---|---|
| Rear Frame | 0.00015 | Less Expansion |
| Front Frame | 0.00005 | Less Expansion |
| Chamber area on barrel: | 57.73 | Reduced Temp |
| Slide muzzle area: | -21.6 | Decreased Temp |
| Frame port side front of slidestop: | -16.7 | Increased Temp |
| Frame non port side front of slidestop: | -30.6 | Reduced Temp |

FIG. 6B

Test TX 36117

| Test 1 - Raw Barrel - No Flutes and No Coating | | Test 2 - Flutes no coating | | Test 3 - Fluted and DLC Coated | |
|---|---|---|---|---|---|
| 200 Rounds Blazer 115 FMJ | | 200 Rounds Blazer 115 FMJ | | 200 Rounds Blazer 115 FMJ | |
| Time | 1.42 | Time | 1.34 | Time | 1.44 |
| Baseline Measurements on Frame Rail | | Baseline Measurements on Frame Rail | | Baseline Measurements on Frame Rail | |
| Rear: | 0.7534 | Rear: | 0.75275 | Rear: | 0.75435 |
| Front: | 0.75285 | Front: | 0.7533 | Front: | 0.754 |
| Temperatures After 200 Rounds | | Temperatures After 200 Rounds | | Temperatures After 200 Rounds | |
| Chamber area on barrel: | 156.2 | Chamber area on barrel: | 145.4 | Chamber area on barrel: | 149.9 |
| Slide muzzle area: | 248 | Slide muzzle area: | 206.6 | Slide muzzle area: | 236.3 |
| Frame port side front of slidestop: | 101.3 | Frame port side front of slidestop: | 100.2 | Frame port side front of slidestop: | 110.3 |
| Frame non port side front of slidestop: | 132.9 | Frame non port side front of slidestop: | 128.6 | Frame non port side front of slidestop: | 113.9 |
| Measurements while hot | | Measurements while hot | | Measurements while hot | |
| Rear: | 0.753 | Rear: | 0.75285 | Rear: | 0.75325 |
| Front: | 0.75415 | Front: | 0.754 | Front: | 0.75525 |

FIG. 6C

Test TX 36117

Variations

Test 2 - Varation from Raw to Fluted

| | | |
|---|---|---|
| Rear Frame | -0.00015 | Expansion |
| Front Frame | -0.0001 | Expansion |
| Chamber area on barrel: | -10.8 | No Change |
| Slide muzzle area: | -41.4 | Reduced Temp |
| Frame port side front of slidestop: | -1.1 | Increased Temp |
| Frame non port side front of slidestop: | -4.3 | Reduced Temp |

Test 3 - Varation from Fluted to Fluted and Coated

| | | |
|---|---|---|
| Rear Frame | 0.0004 | Expansion |
| Front Frame | 0.00125 | Expansion |
| Chamber area on barrel: | 4.5 | Reduced Temp |
| Slide muzzle area: | 29.7 | Increased Temp |
| Frame port side front of slidestop: | 10.1 | Increased Temp |
| Frame non port side front of slidestop: | -14.7 | Reduced Temp |

Overal Imrprovements from Test 1 to Test 3

| | | |
|---|---|---|
| Rear Frame | 0.00025 | Less Expansion |
| Front Frame | 0.0011 | Less Expansion |
| Chamber area on barrel: | -6.3 | Reduced Temp |
| Slide muzzle area: | -11.7 | Decreased Temp |
| Frame port side front of slidestop: | 9 | Increased Temp |
| Frame non port side front of slidestop: | -19 | Reduced Temp |

FIG. 6D

Test TX 36086

| Test 1 - Raw Barrel - No Flutes and No Coating | | Test 2 - Flutes no coating | | Test 3 - Fluted and DLC Coated | |
|---|---|---|---|---|---|
| 200 Rounds Blazer 115 FMJ | | 200 Rounds Blazer 115 FMJ | | 200 Rounds Blazer 115 FMJ | |
| Time | 2.19 | Time | 2.27 | Time | 1:38 |
| Baseline Measurements on Frame Rail | | Baseline Measurements on Frame Rail | | Baseline Measurements on Frame Rail | |
| Rear: | 0.75215 | Rear: | 0.75305 | Rear: | 0.75265 |
| Front: | 0.75455 | Front: | 0.7547 | Front: | 0.7534 |
| Temperatures After 200 Rounds | | Temperatures After 200 Rounds | | Temperatures After 200 Rounds | |
| Chamber area on barrel: | 146.3 | Chamber area on barrel: | 146.3 | Chamber area on barrel: | 117.1 |
| Slide muzzle area: | 194 | Slide muzzle area: | 189.5 | Slide muzzle area: | 203.4 |
| Frame port side front of slidestop: | 96.8 | Frame port side front of slidestop: | 99.5 | Frame port side front of slidestop: | 92.3 |
| Frame non port side front of slidestop: | 119.3 | Frame non port side front of slidestop: | 105.8 | Frame non port side front of slidestop: | 96.3 |
| Measurements while hot | | Measurements while hot | | Measurements while hot | |
| Rear: | 0.75345 | Rear: | 0.75345 | Rear: | 0.7529 |
| Front: | 0.7551 | Front: | 0.755 | Front: | 0.75425 |

FIG. 6E

Test TX 36086

Variations

Test 2 - Varation from Raw to Fluted

| | | |
|---|---|---|
| Rear Frame | 0 | Expansion |
| Front Frame | -0.0001 | Expansion |
| Chamber area on barrel: | 0 | |
| Slide muzzle area: | -4.5 | Reduced Temp |
| Frame port side front of slidestop: | 2.7 | Increased Temp |
| Frame non port side front of slidestop: | -13.5 | Reduced Temp |

Test 3 - Varation from Fluted to Fluted and Coated

| | | |
|---|---|---|
| Rear Frame | -0.00055 | Expansion |
| Front Frame | -0.00075 | Expansion |
| Chamber area on barrel: | -29.2 | |
| Slide muzzle area: | 13.9 | Increased Temp |
| Frame port side front of slidestop: | -7.2 | Increased Temp |
| Frame non port side front of slidestop: | -9.5 | Reduced Temp |

Overal Imrprovements from Test 1 to Test 3

| | | |
|---|---|---|
| Rear Frame | -0.00055 | Less Expansion |
| Front Frame | -0.00085 | Less Expansion |
| Chamber area on barrel: | -29.2 | Reduced Temp |
| Slide muzzle area: | 9.4 | Increased Temp |
| Frame port side front of slidestop: | -4.5 | Reduced Temp |
| Frame non port side front of slidestop: | -23 | Reduced Temp |

FIG. 6F

Overall Measurement Averages

| Variations | | |
|---|---|---|

| Test 2 - Varation from Raw to Fluted | | |
|---|---|---|
| Rear Frame | 0.00002 | Expansion |
| Front Frame | -0.00010 | Less Expansion |
| Chamber area on barrel: | -4.80000 | Reduced Temp |
| Slide muzzle area: | -12.90000 | Reduced Temp |
| Frame port side front of slidestop: | -0.06667 | Increased Temp |
| Frame non port side front of slidestop: | -12.23333 | Reduced Temp |

| Test 3 - Varation from Fluted to Fluted and Coated | | |
|---|---|---|
| Rear Frame | -0.000067 | Less Expansion |
| Front Frame | 0.000167 | Expansion |
| Chamber area on barrel: | 12.210000 | Increased Temp |
| Slide muzzle area: | 4.933333 | Increased Temp |
| Frame port side front of slidestop: | -4.000000 | Decreased Temp |
| Frame non port side front of slidestop: | -11.966667 | Reduced Temp |

| Overal Imrprovements from Test 1 to Test 3 | | |
|---|---|---|
| Rear Frame | -0.000050 | Less Expansion |
| Front Frame | 0.000100 | Expansion |
| Chamber area on barrel: | 7.410000 | Increased Temp |
| Slide muzzle area: | -7.966667 | Decreased Temp |
| Frame port side front of slidestop: | -4.066667 | Decreased Temp |
| Frame non port side front of slidestop: | -24.200000 | Decreased Temp |

FIG. 6G

FIREARM

CROSS-REFERENCE TO RELATED APPLICATION

This application claims priority under 35 U.S.C. § 119 to U.S. Application Ser. No. 63/418,839, filed on Oct. 24, 2022, the entire contents of which is incorporated by reference.

TECHNICAL FIELD

This disclosure relates to a firearm. In particular, this disclosure relates to a precision-built pistol.

BACKGROUND

Precise and reliable operation are key features for any firearm. However, improvements in precision typically result in sacrifices in reliability, and improvements in reliability typically result in sacrifices in precision.

Shooting precision is obtained by consistent operation of firearm components. For instance, in a semi-automatic firearm it is desirable for the breach on the slide to mate at as close to the exact same location on the rear face of the chamber ever time the firearm is cycled. Likewise, it is desirable for the barrel to rest in the exact same location at the end of the slide as possible each time the firearm returns to battery. Such exactness in machining ensure consistency of operation and precision in shooting, assuming the use of quality ammunition. Such precision results from using tight manufacturing tolerances. However, the same tight manufacturing tolerances can result in reduced reliability as debris from shooting or the environment work its way into the mechanical operation of the firearm. Reliability is typically achieved with looser tolerances, thus sacrificing precision.

The present disclosure presents improvements that balance both precision and reliability.

SUMMARY

In general, innovative aspects of the subject matter described in this specification include features for a firearm. In an example aspect, In an example aspect combinable with any other example aspect, the lubricating oil positioned in the groove contacts a surface of the slide rail.

In an example aspect combinable with any other example aspect, responsive to motion of the slide relative to the frame, the lubricating oil wicks from the lubrication groove to the surface of the slide rail.

In an example aspect combinable with any other example aspect, the lubrication groove a first tapered portion and a second tapered portion. The first tapered portion extends from a first end of the groove to the surface of the frame. The second tapered portion extends from a second end of the groove opposite the first end to the surface of the frame.

In an example aspect combinable with any other example aspect, the lubrication groove includes a wicking material disposed within the groove.

In an example aspect combinable with any other example aspect, the frame rail has a first segment and a second segment separated by the debris removal port. The lubrication groove is located on a first segment. The second segment includes a second lubrication groove that is substantially aligned with the lubrication groove.

In an example aspect combinable with any other example aspect, the debris removal port is a first debris removal port located proximate to a first end of the lubrication groove and the frame rail has a second debris removal port located proximate to a second end of the lubrication groove.

In an example aspect combinable with any other example aspect, the debris removal port has a semi-circular gap extending from a top surface to a bottom surface of the frame rail.

In an example aspect combinable with any other example aspect, the firearm further includes a barrel disposed within the slide. The barrel has multiple flutings extending along a portion of an outer surface of the barrel.

In an example aspect combinable with any other example aspect, the barrel has a rear surface that engages with a breach surface of the slide. At least one of the flutings extends through the rear surface forming a semi-circular profile with the rear surface.

In an example aspect combinable with any other example aspect, at least one of the flutings terminates rearward of a locking lug located on an upper portion of the outer surface of the barrel.

In an example aspect combinable with any other example aspect, the at least one of the flutings extends past a locking lug located on an upper surface of the barrel.

In an example aspect combinable with any other example aspect, the barrel includes a barrel hood with a chamfered upper surface.

In an example aspect combinable with any other example aspect, the barrel includes an ejection port region on the outer surface of the barrel that aligns with an ejection port of the slide with the slide in a battery position. The ejection port region includes a closed-loop concave groove within the outer surface of the barrel.

In an example aspect combinable with any other example aspect, the slide has a region on an upper surface of the slide that is formed into a generally planar surface configured to mate with a cover plate. The generally planar surface includes at least one weight reduction cut extending below the generally planar surface.

In an example aspect combinable with any other example aspect, the at least one weight reduction cut exposes a firing pin spring within the slide.

In an example aspect combinable with any other example aspect, the at least one weight reduction cut extends from the generally planar surface through to a bottom interior surface of the slide.

In an example aspect combinable with any other example aspect, the firearm includes a trigger installed within the frame. The trigger has a boss extending from a front trigger surface. The boss engages with an internal surface of the frame to form a trigger over-travel stop.

In an example aspect, a frame for a firearm has a frame rail. The frame rail interfaces with a slide rail of a firearm slide with the slide attached. The frame rail has a lubrication groove and a debris removal port. The lubrication groove extends along a surface of the frame rail that bears against the slide rail during operation of the firearm. The debris removal port has a gap within the frame rail proximate to an end of the lubrication groove.

In an example aspect, a firearm barrel has multiple flutings, a rear surface, a locking lug, a barrel hood, and an ejection port region. The flutings extend along a portion of an outer surface of the barrel. The rear surface engages with a breach surface of a firearm slide. The locking lug is located on a top portion of the outer surface of the barrel. The barrel hood has a chamfered upper surface. The ejection port region on the outer surface of the barrel that aligns with an ejection port of the slide with the slide in a battery position.

The ejection port region has a closed-loop concave groove within the outer surface of the barrel. A first one of the flutings extends through the rear surface forming a first semi-circular profile with the rear surface and terminates rearward of the locking lug. A second one of the flutings extends through the rear surface forming a second semi-circular profile with the rear surface and extends past the locking lug. A third one of the flutings extends along a portion of the barrel forward of the ejection port region.

DESCRIPTION OF DRAWINGS

FIGS. 6A-6G depict experimental data from heat testing of the example barrel of FIG. 3A.

DETAILED DESCRIPTION

Figure 1A:
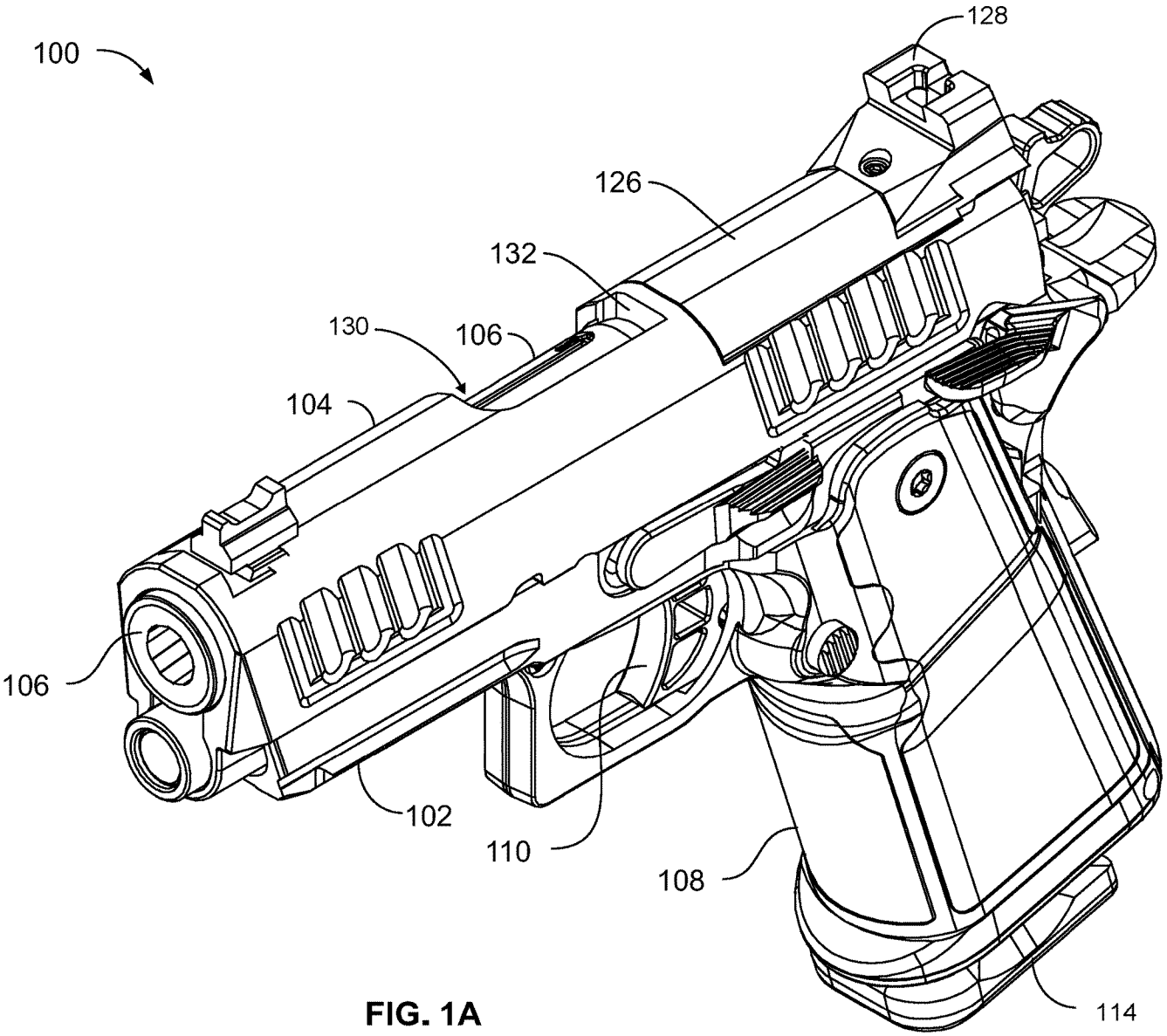
FIG. 1A depicts a perspective view of an example firearm in accordance with implementations of the present disclosure.
Figure 1B:
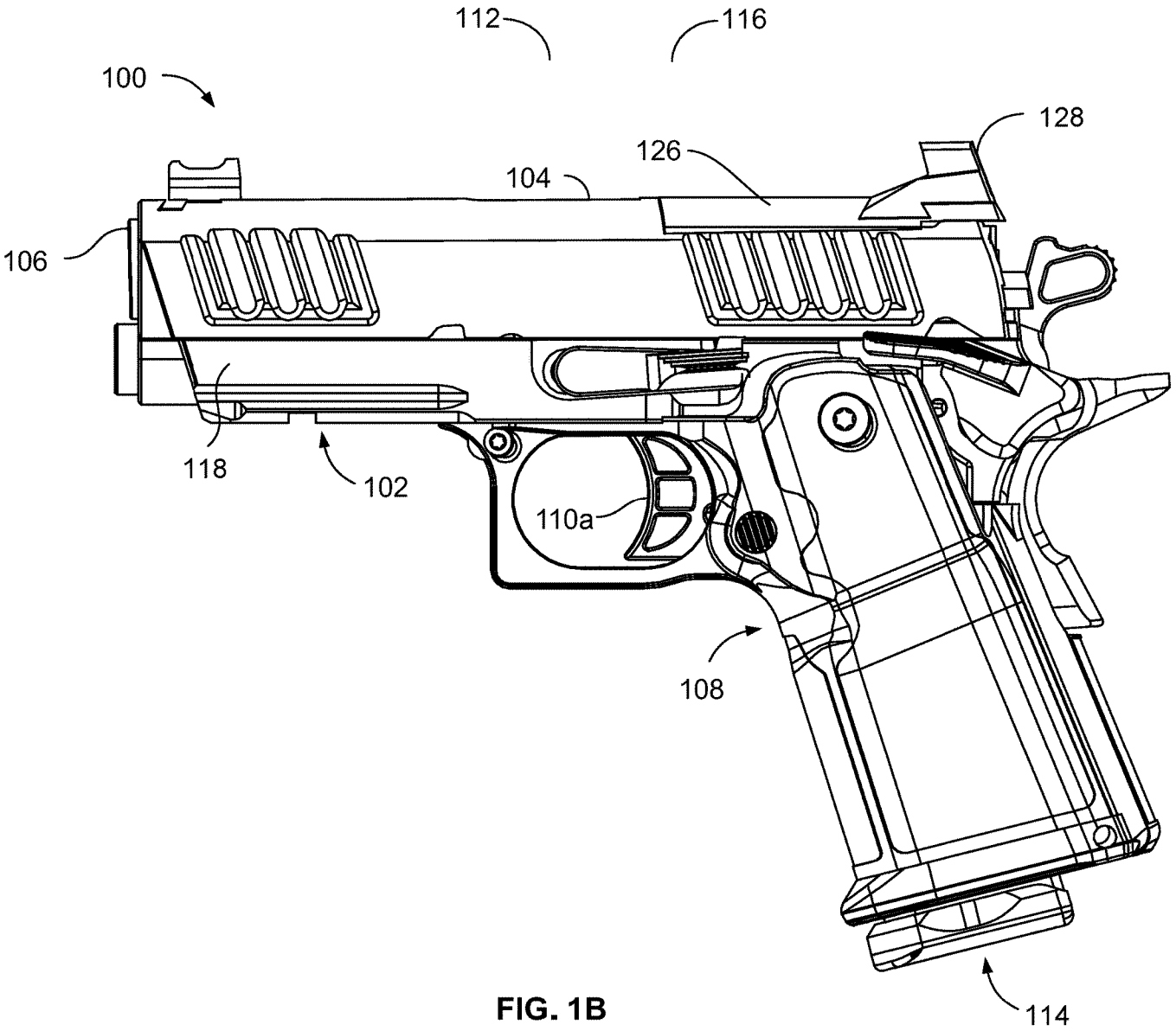
FIG. 1B depicts a side view of the example firearm of FIG. 1A.
Figure 1C:
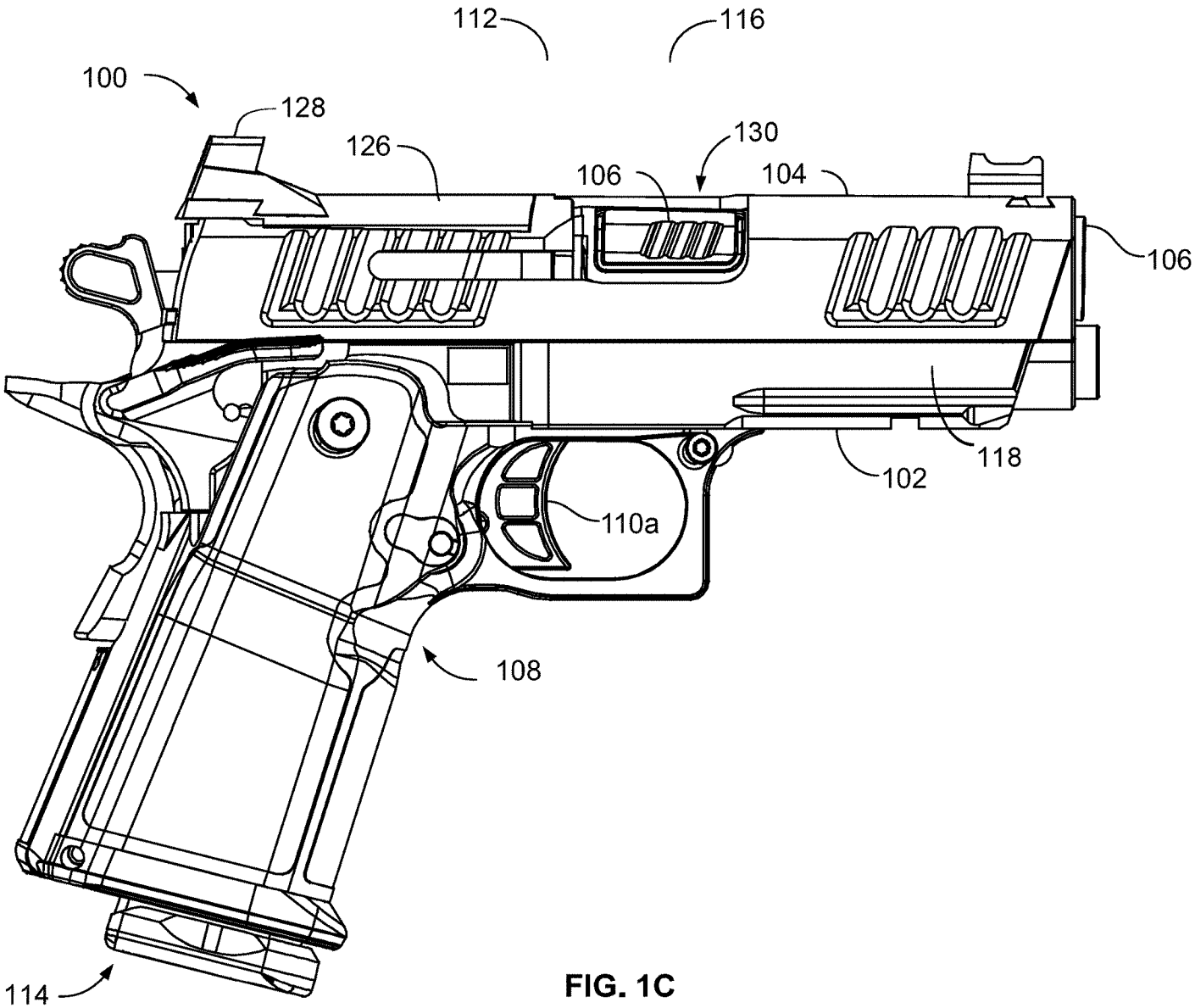
FIG. 1C depicts another side view of the example firearm of FIG. 1A.
Figure 1D:
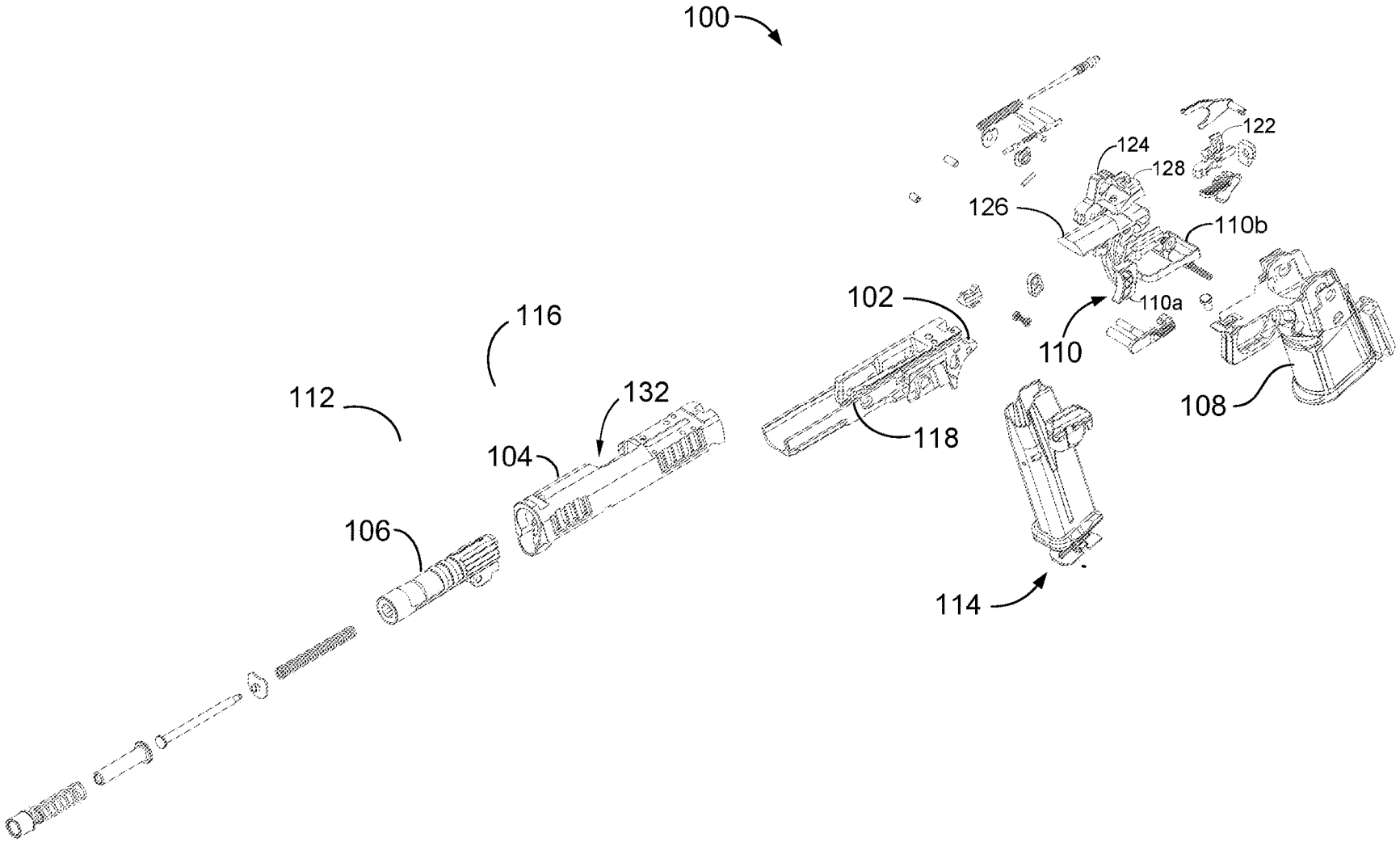
FIG. 1D depicts an exploded view of the example firearm of FIG. 1A.

Implementations of the present disclosure are generally directed to several features that improve the operation of a firearm. For simplicity, implementations of the present disclosure will be described in reference to a semiautomatic handgun, however, one skilled in the art would appreciate that one or more of the implementations described below also may be incorporated into other firearms designs. For example, one or more of these features may be incorporated into a revolver, a bolt-action rifle, or a semi-automatic rifle, or an automatic rifle.

One or more of the implementations described herein can increase a lifetime of the firearm, reduce friction and wear between components, or decrease corrective maintenance of firearm components.

Referring to FIGS. 1A-D, a firearm 100 has a frame 102 with a grip 108 for an operator (not shown) to hold the firearm 100. The firearm 100 has a slide 104 coupled to the frame 102. The slide 104 houses a barrel 106. The barrel 106 holds a cartridge (not shown) containing a bullet and conducts the bullet from the firearm 100 in a forward direction 112 when the firearm 100 is fired. The slide 104 moves relative to the frame 102 (in the forward direction 112) to align the barrel 106 to receive another cartridge from a magazine 114 positioned within the grip 108 of the frame 102. The slide 104 moves relative to the frame 102 (in a rearward direction 116 opposite the forward direction 112) to chamber the next cartridge from the magazine 114.

Figure 5A:
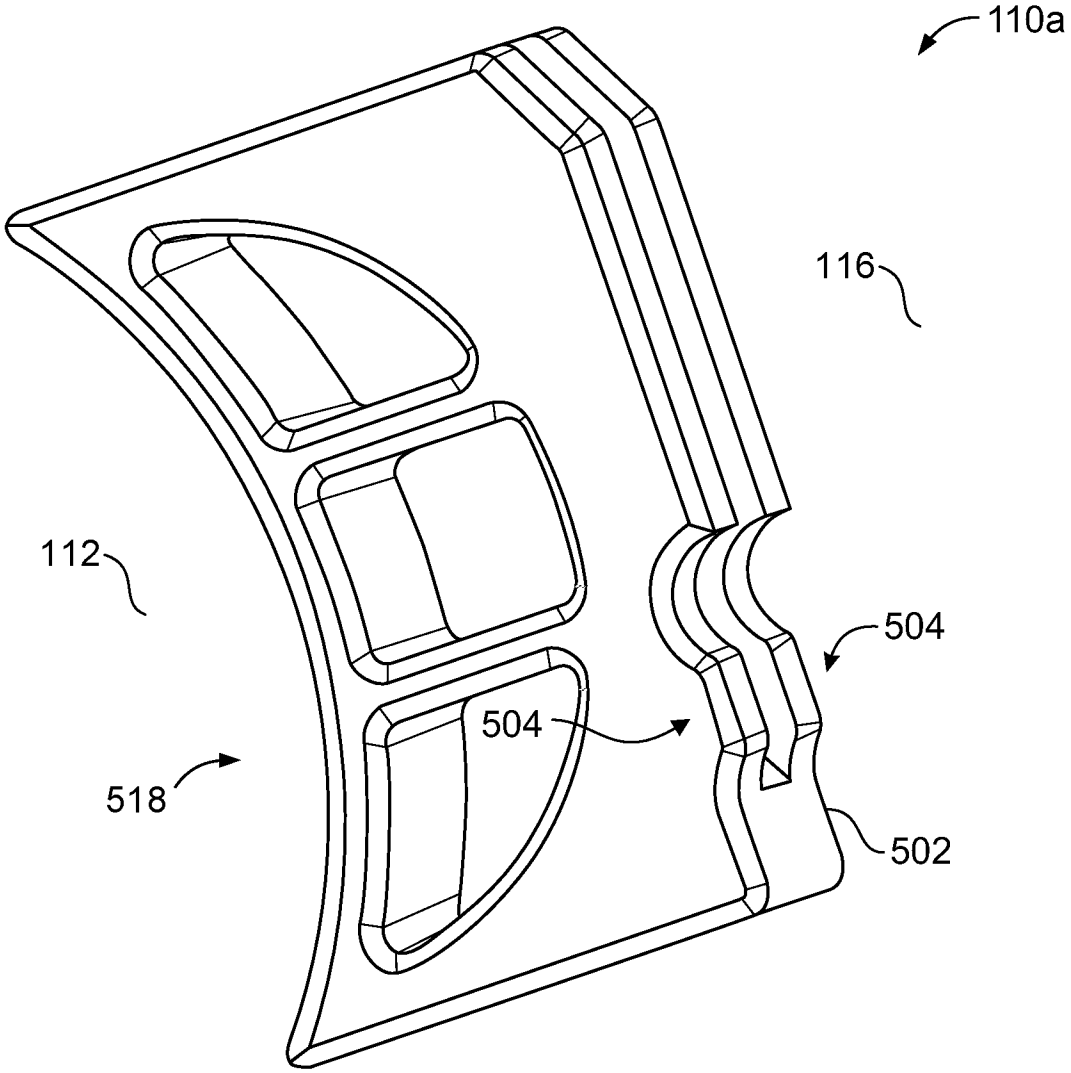
FIG. 5A depicts a perspective view of an example trigger of the example firearm of FIG. 1A.
Figure 5B:
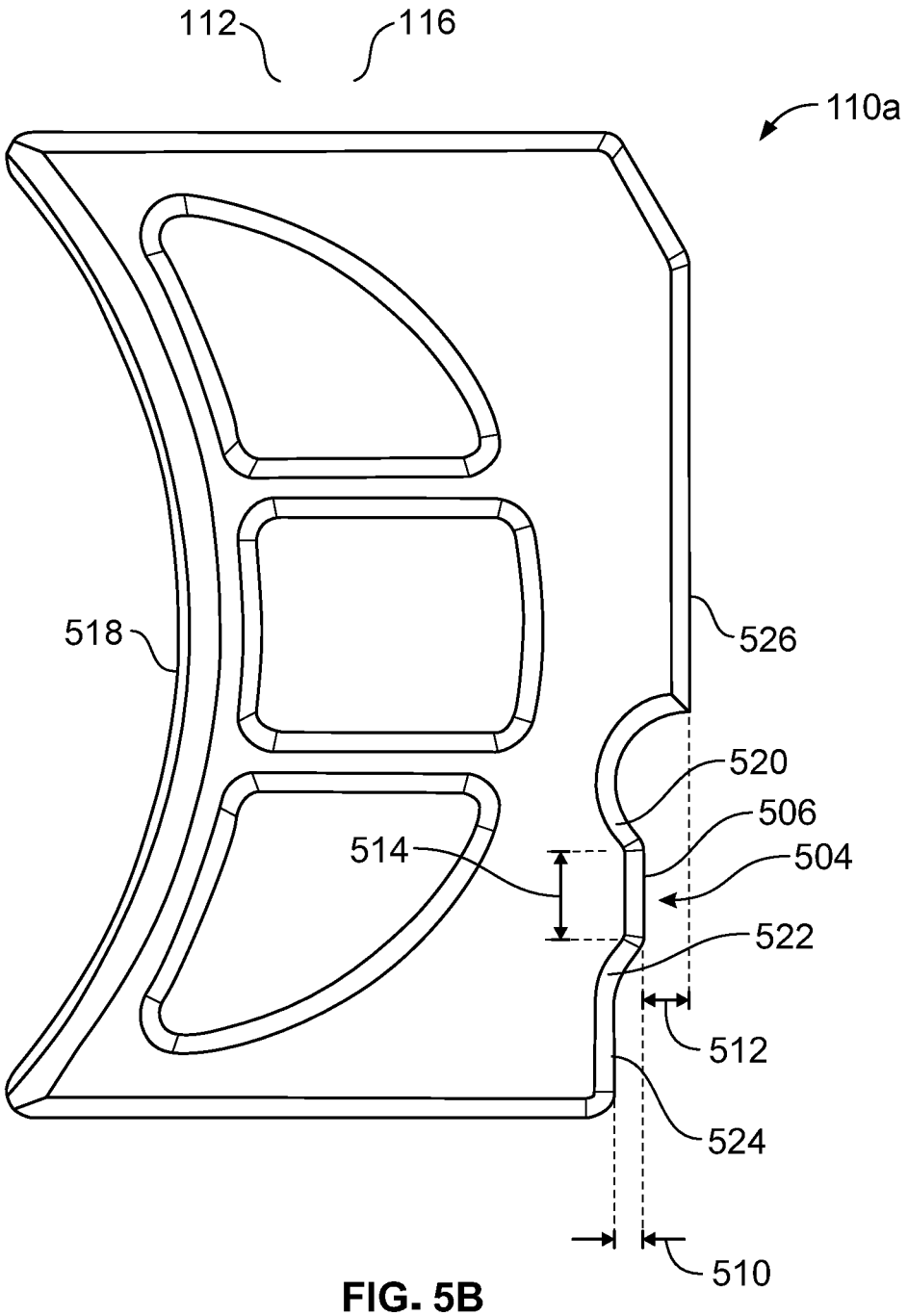
FIG. 5B depicts a side view of the example trigger of FIG. 5A.
Figure 5C:
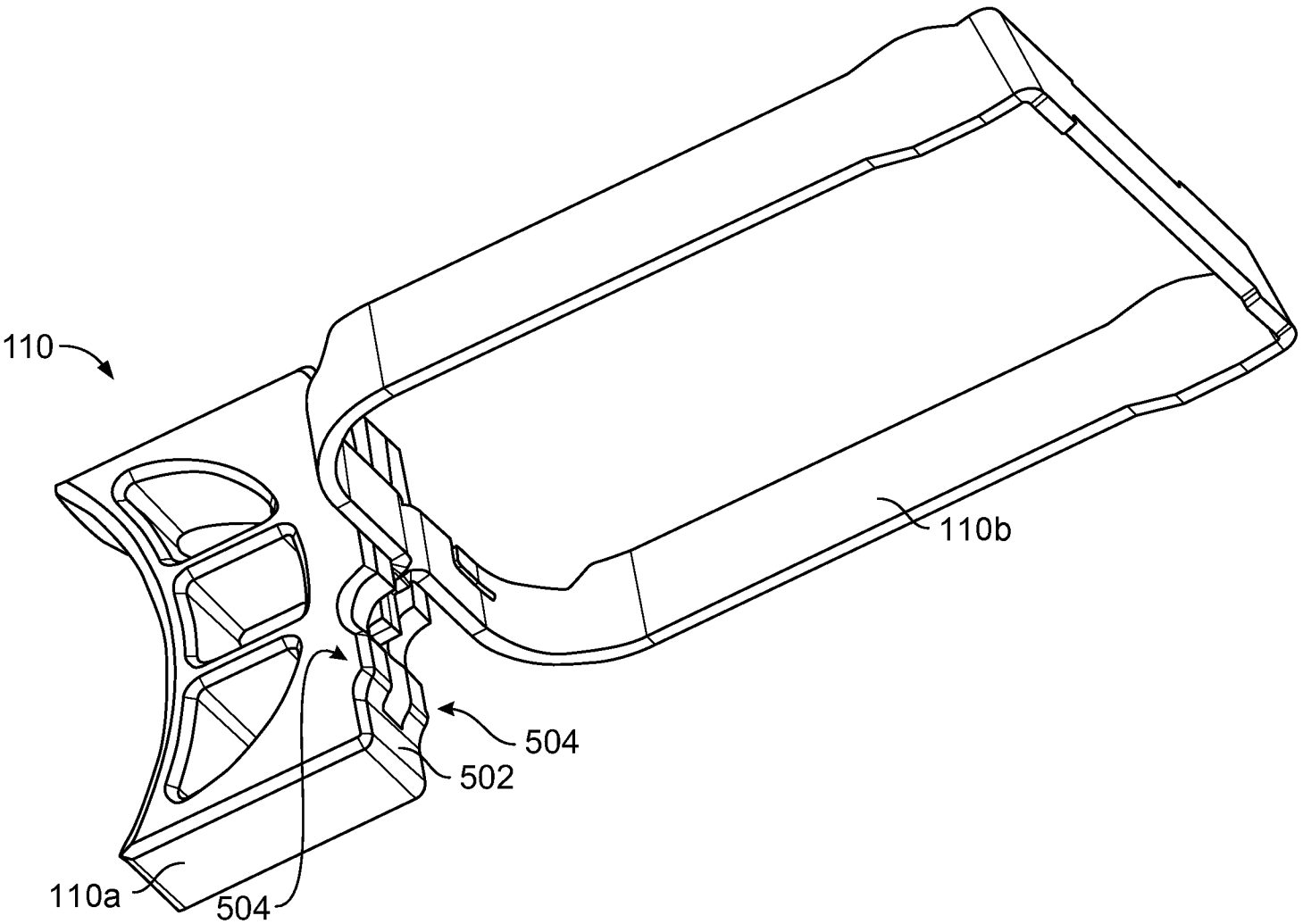
FIG. 5C depicts a rear perspective view of the example trigger of FIG. 5A.

The frame 102 houses the fire control components of the firearm 100. For example, referring to FIG. 1D, the frame 102 houses the trigger assembly 110, the sear 122, and the hammer 124. The trigger assembly includes the trigger 110*a* and the trigger bar 110*b* (shown in more detail in FIG. 5C). In operation, the trigger assembly interface with the sear 122 to release the hammer 124 and fire a cartridge loaded in the firearm's chamber.

The slide 104 includes a cover plate 126 attached on the top side. A rear sight 128 is attached to the top of the cover plate 126. The cover plate 126 is detachable and can be replaced with other cover plates 126 that are configured to accept optical sights (not shown), e.g., red dot sights. The slide includes an ejection port 130 that centers over a chamber region of the barrel 106 when the firearm 100 is in battery.

Figure 2A:
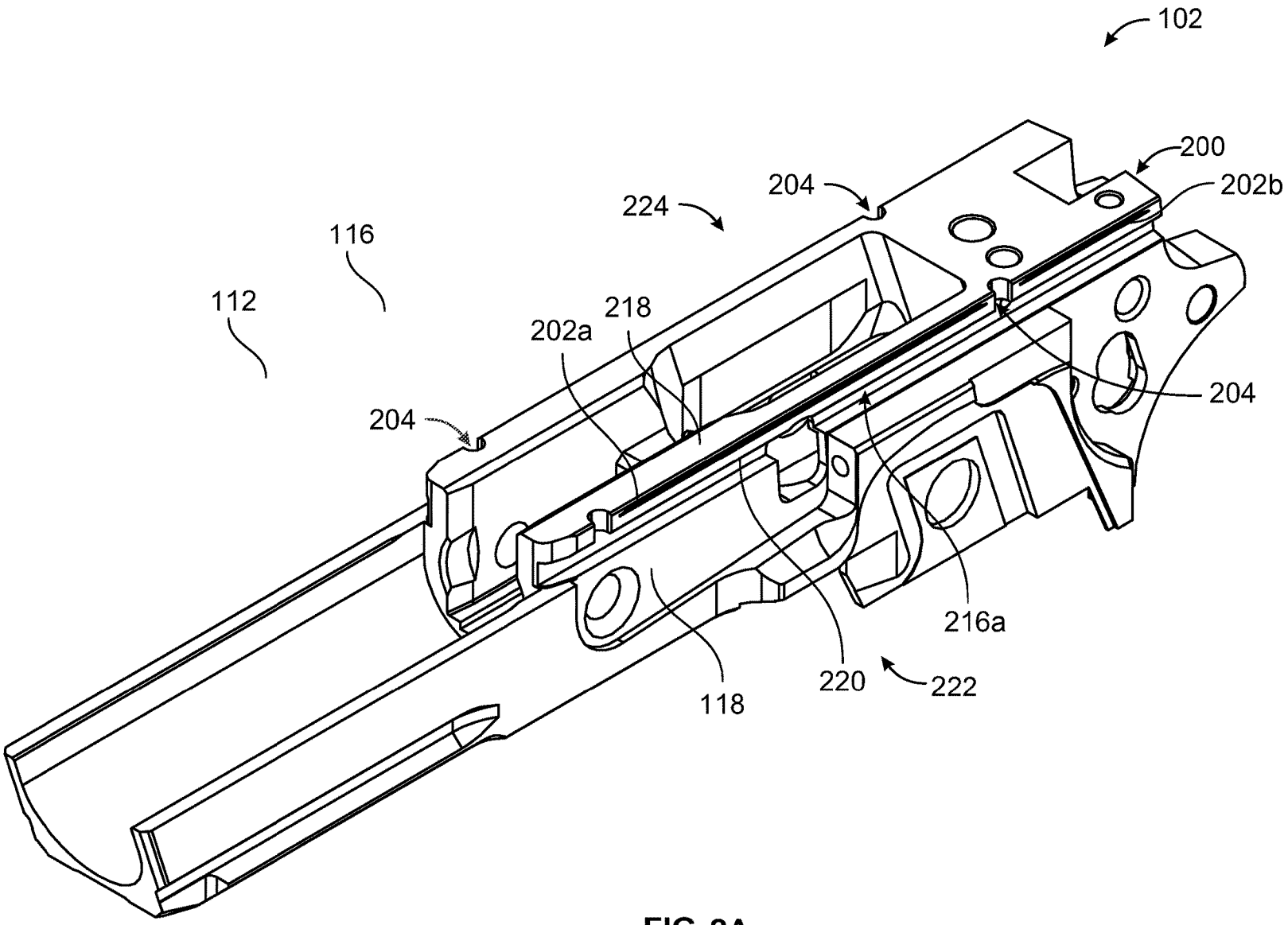
FIG. 2A depicts a perspective view of an example frame of the example firearm of FIG. 1A in accordance with implementations of the present disclosure.
Figure 2B:
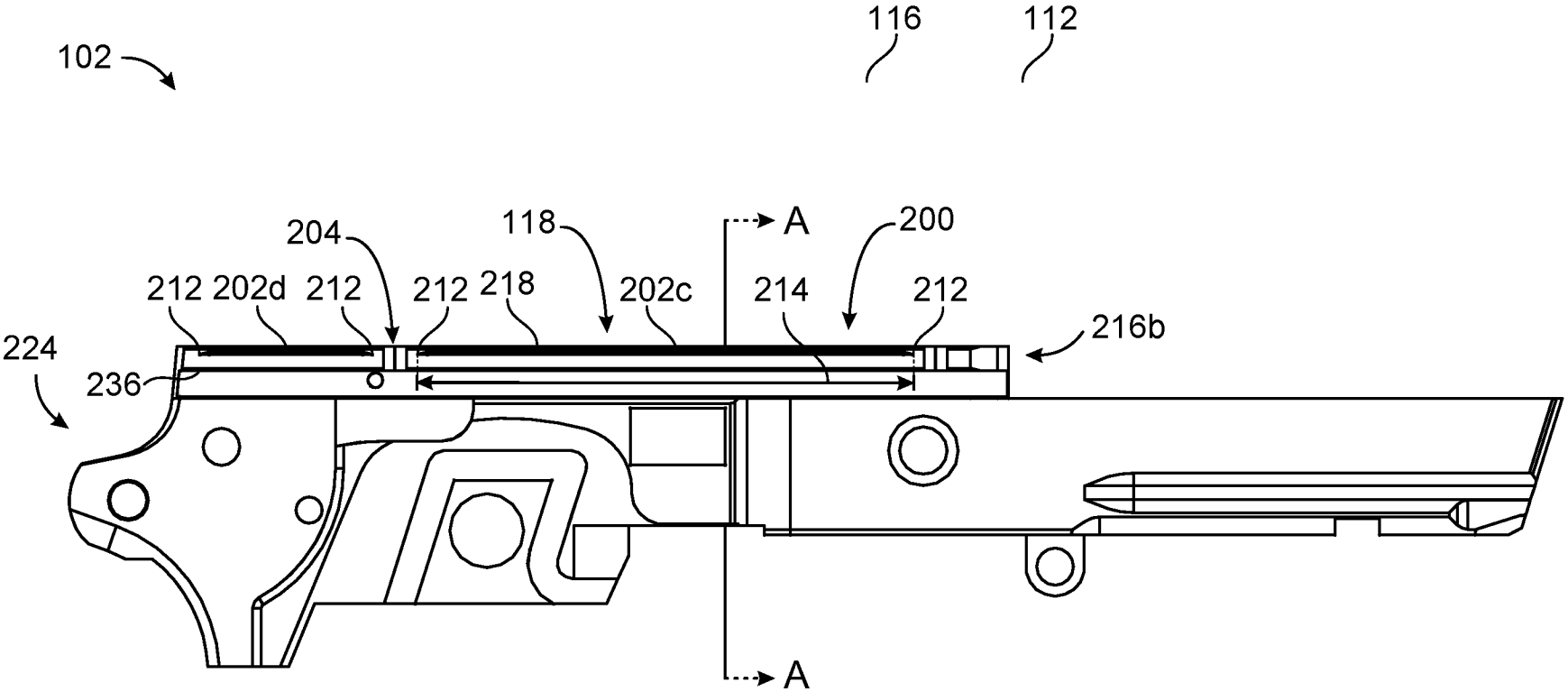
FIG. 2B depicts a side view of the example frame of FIG. 2A.
Figure 4:
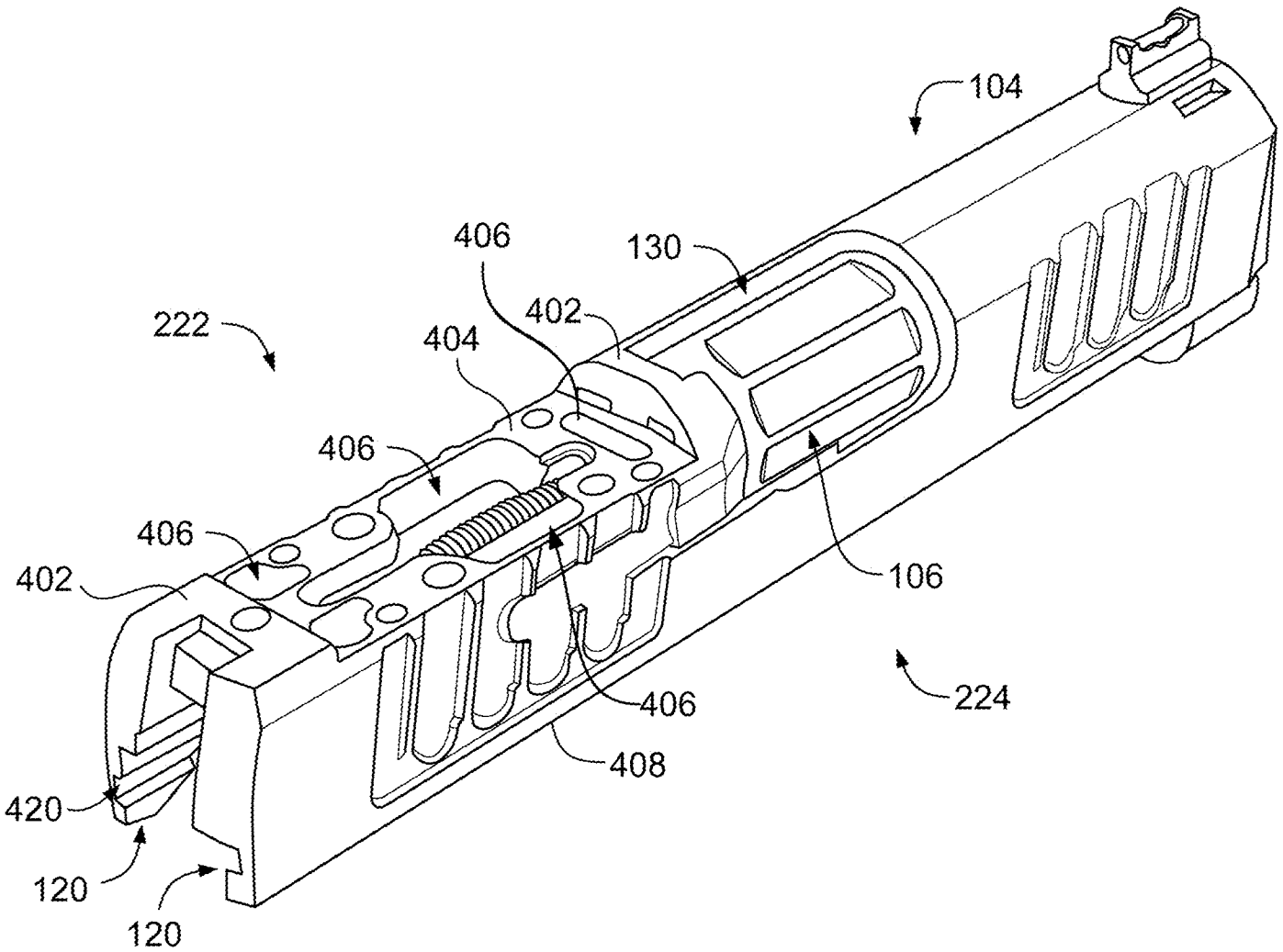
FIG. 4 depicts a perspective view of an example slide of the example firearm of FIG. 1A.

Referring to FIGS. 2A-2B and 4, the frame 102 and slide 104 each have corresponding rails 216 and 420. The frame rails 216 are configured to mate with the slide rails 420 on the slide 104. In the firearm 100 depicted, the frame rails 216 are formed on an outer surface 118 of the frame 102 and the slide rails 420 are formed in an inner surface of the slide 104. When the slide 104 moves relative to the frame 102, wear may occur on some areas of either or both of the slide rails 420 or the frame rails 216. However, in some configuration, the configuration can be reversed. For example, the frame rails 216 can be formed on an inner surface of the frame and the slide rails 420 can be formed on an outer surface of the slide.

Referring to FIGS. 2A-2G, the firearm 100 includes an oil lubrication reservoir 200 to provide a quantity of oil for lubricating (lubricating oil) portions of the frame 102 and the slide 104. The oil lubrication reservoir 200 can be formed as a groove cut within a surface of the frame rail 216. For example, as illustrated the lubrication reservoir 200 includes grooves 202*a*, 202*b*, 202*c*, and 202*d* which can contain the lubricating oil. The lubrication reservoir 200 holds oil to lubricate the surfaces of the frame rails 216 that bear against corresponding surfaces of the slide rails 420. As the slide 104 is cycled during firearm operation some of the oil contained within the lubrication reservoir 200 is transferred to the bearing surfaces of the frame rails 216. This wicking action provides lubrication for continued operation and improves the overall reliability of the firearm 100. For instance, firearms that are designed for precision shooting use tighter engineering tolerances between engagement surfaces of the frame and slide rails. In other words, the rails are designed for a tighter fit between the slide 104 and frame 102 to reduce lateral movement between the parts which can result in inconsistent barrel alignment (and consequently a less precise firearm). However, as a firearm is used, debris from the combustion of gunpowder and the environment build up between the frame and slide rails increasing friction, and eventually causing malfunctions (e.g., a failure to extract, or failure to feed a new round). Firearms that are designed more for reliability permit greater tolerances between the slide and frame so such build of debris has less of an effect on their operation. The oil lubrication reservoir 200 provides a location for lubricant to be retained between the slide and frame rails. This improves the overall reliability of the firearm while still permitting a precise fit between the slide 104 and the frame 102 along the respective slide and frame rails 420, 216.

As shown in FIG. 2B, the grooves 202*a* are 202*b* of the lubrication reservoir 200 are positioned on a first side 222 (a left side relative to the operator holding the firearm 100) of the frame 102. As shown in FIG. 2G, the grooves 202*c* and 202 are positioned on a second side 224 (a right side of the firearm 100 relative to the operator holding the firearm 100) of the frame 102. In some implementations, the firearm 100 can include only one groove, two or three grooves, or even more than four grooves.

The grooves 202*a-d* can be on a first frame rail 216*a* (left side) and second frame rail 216*b* (right side) of the frame 102. The frame rails 216*a*, 216*b* extend along a longitudinal axis (oriented along the rearward direction 116 to the forward direction 112) of the frame 102. The grooves 220*a-d* are oriented toward the first side 222 and the second side 224. The grooves 202*a-d* are shown on the outside wall 234 of the frame rails 216*a*, 216*b*. However, in other implementations, the groove 202*a-b* can be on and extend into the frame 102 from a top surface 218 of the frame rails 216*a*, 216*b* and/or the bottom surface 236. In some implementations, the grooves 202*a-d* can be on the outside wall 234 and extending to the top surface 218 of the frame rails 216*a*, 216*b* or the bottom surface 236. In some implementations, the grooves 202*a-d* can be positioned on other surfaces such as top surfaces, upward facing surfaces, downward facing surfaces, or angled upward or downward.

The grooves 202*a-d* extend from the outer surface 118 into the frame 102. The grooves 220*a-d* can retain the lubricating oil for continued lubrication of the firearm 100 during operations. In some implementations, the lubricating oil retained in the grooves 202*a-d* contacts the inner surface 120 of the slide 104. In some implementations, a motion of the slide 104 relative to the frame 102 wicks a portion of the lubricating oil from one or more of the grooves 202*a-d* to the inner surface 120 of the slide 104.

One or more of the grooves 202*a-d* can have tapered portions transitioning the respective groove to the outer surface 118. For example, in this implementation, as shown in FIG. 2G, the groove 202 has a first tapered portion 212*a* extending from a first end 226 of the groove 202*a* to the outer surface 118 and a second tapered portion 212*b* extending from a second end 228 of the groove 202*a* to the outer surface 118. The second end 228 of the groove 202*a* is opposite the first end 226. The groove 220*b* has a first tapered portion 212*c* extending from a first end 230 of the groove 202*b* to the outer surface 118 and a second tapered portion 212*d* extending from a second end 232 of the groove 202*b* to the outer surface 118. For example, the grooves 220*a-d* can be machined into the surface of the frame rails 216.

The grooves 202*a-d* have a cross-section 206 defined by a height 208 and a depth 210. The height 208 of the grooves 202*a-d* is along the outside wall 234 of the frame rails 216*a*, 216*b*. The depth 210 extends into the frame 102 (the frame rails 216*a*, 216*b*). In some implementations, the cross-section 206 is triangular. For example, the cross-section 206 can be an equilateral triangle, an isosceles triangle (in one or more orientations relative to the outside wall 234, a scalene triangle, an acute triangle, a right triangle, or an obtuse triangle. In other implementations, the cross-section 206 can have other shapes, e.g., a semi-circular cross-section, U-shaped cross-section, etc. In some implementations, the cross-section 206 can vary. That is, the height 208, depth 210, and shape can change one or more times along the grooves 202*a-d*. Each of the grooves 202*a-d* can have the same or different cross-section 206. The grooves 202*a-d* have a length 214 (shown in reference to groove 202*c* in FIG. 2B).

In some implementations, an oil reservoir 200 can be formed within the slide rails 420 in addition, or alternatively to forming the oil reservoir within the frame rails 216. For example, grooves similar to those shown in the frame rails 216 can be machined into one or more of the surfaces that form the slide rails 420.

In some implementations, a wicking material can be inserted within or fixed within the lubrication reservoirs 200. For example, fibrous plugs can be installed within the lubrication reservoir at one or more locations to aid in wicking oil from the reservoir onto surfaces of the slide rail 420. The wicking material may serve to brush the oil onto the slide rails 420 as the slide 104 is cycled.

The frame 102 for the firearm 100 can have debris removal ports 204. The debris removal ports 204 can be located proximate to the ends of the oil lubrication reservoirs 200. Debris removal ports 204 serve to remove debris (e.g., combustion debris or environmental debris such as dust) that may accumulate between the frame rails 216 and the slide rails 420. Similar to the oil lubrication reservoir 200, the debris removal ports improve the operational reliability of the firearm 100 while permitting a precise fit between the slide 104 and the frame 102.

The debris removal ports 204 can be formed by voids or cutouts in the frame rail 216. For instance, the voids can extend from the top surface 218 of the frame rail 216 completely through to the bottom surface 236 of the frame rail 216. The debris removal ports 204 can receive a debris from a space outside the debris removal ports 204. In other words, the debris removal ports 204 can collect debris from between the frame 102 and the slide 104. The debris removal ports 204 serve to remove debris from between frame 102 and the slide 104. For example, lubricating oil between the frame 102 and the slide 104 can entrain debris. Motion of the slide 104 relative to the frame 102 can conduct or force debris or debris entrained in the lubricating oil into the debris removal ports 204. The debris removal ports 204 divide the frame rail 216 into individual segments. As depicted in FIG. 2A two of the segments include oil lubrication reservoir grooves 202*a* and 202*b*.

Figure 2C:
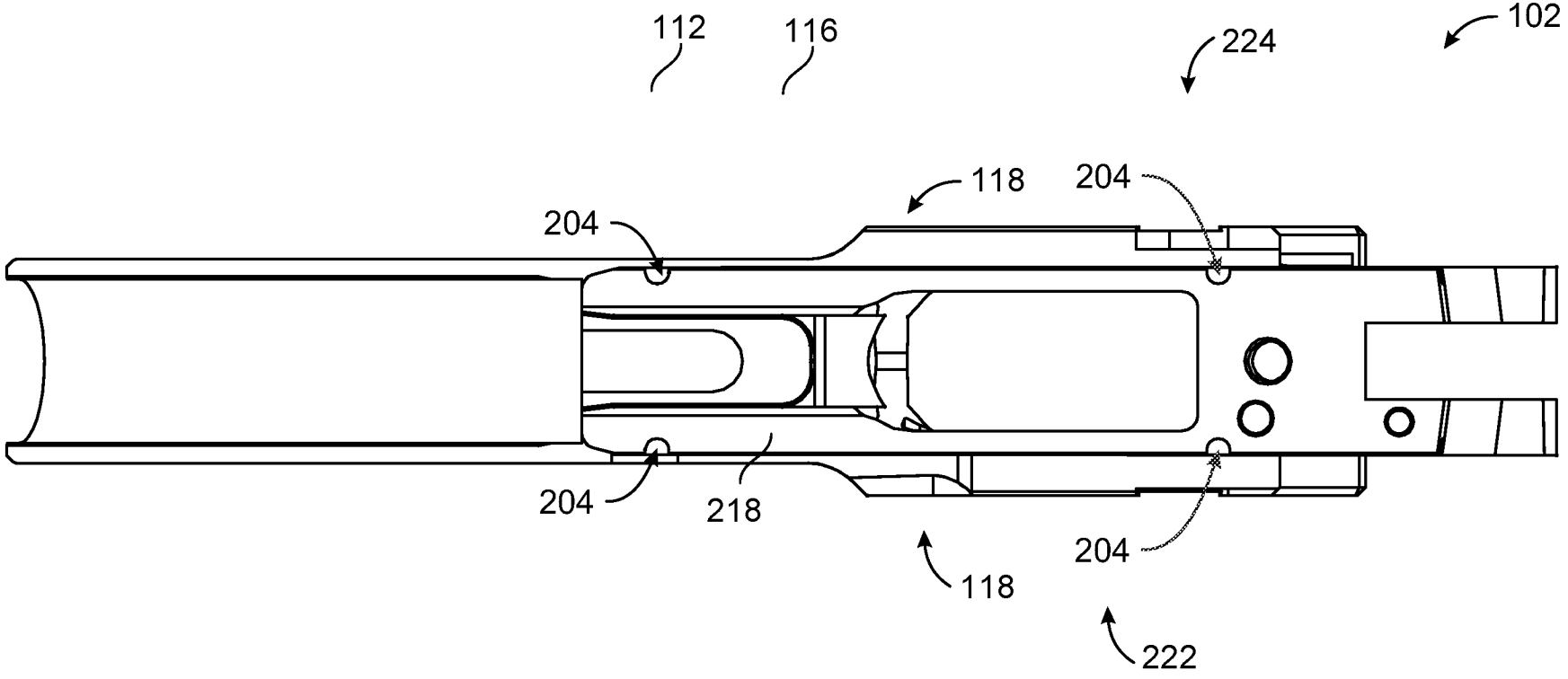
FIG. 2C depicts a top view of the example frame of FIG. 2A.
Figure 2D:
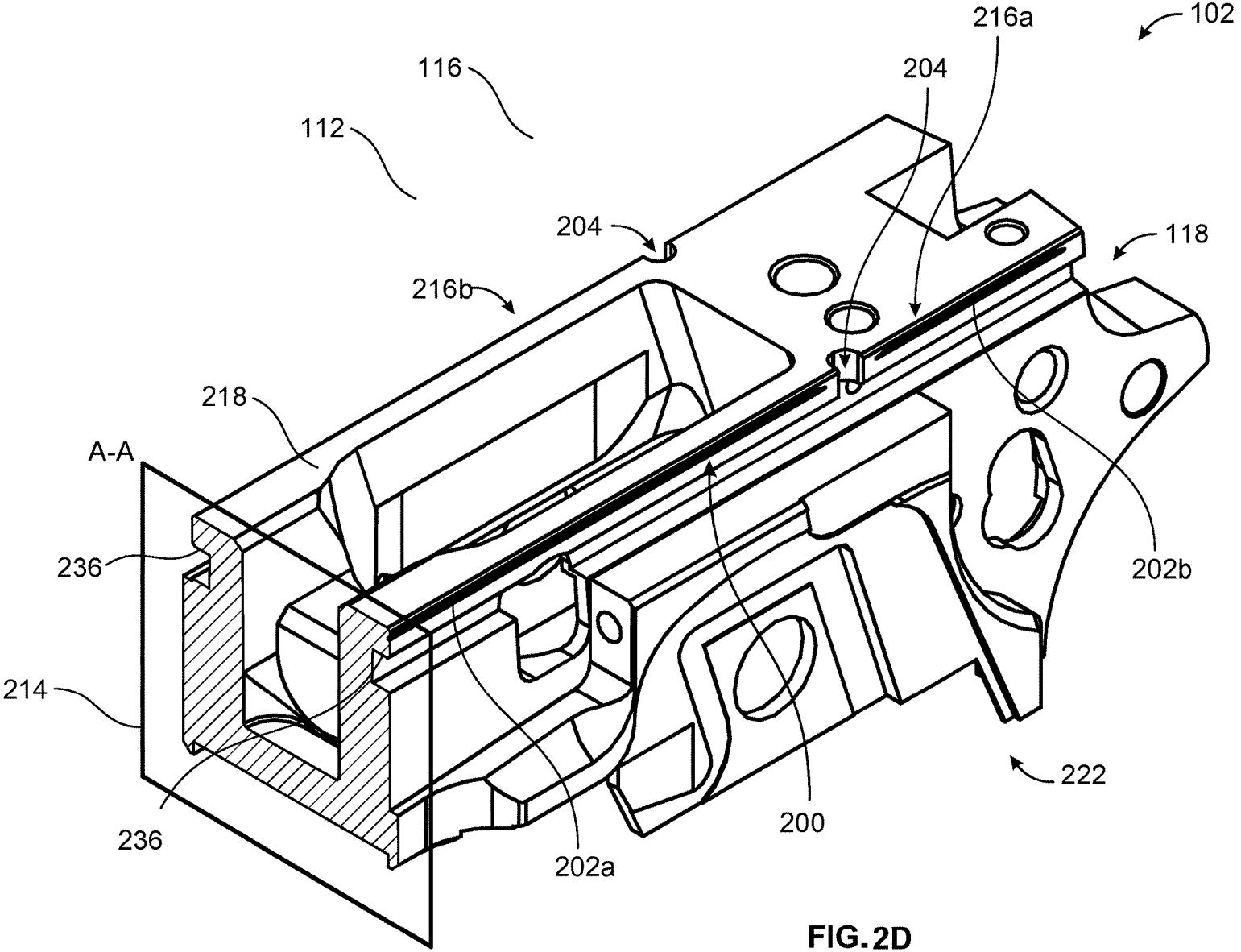
FIG. 2D depicts a perspective cross-section view of the example frame of FIG. 2A.
Figure 2E:
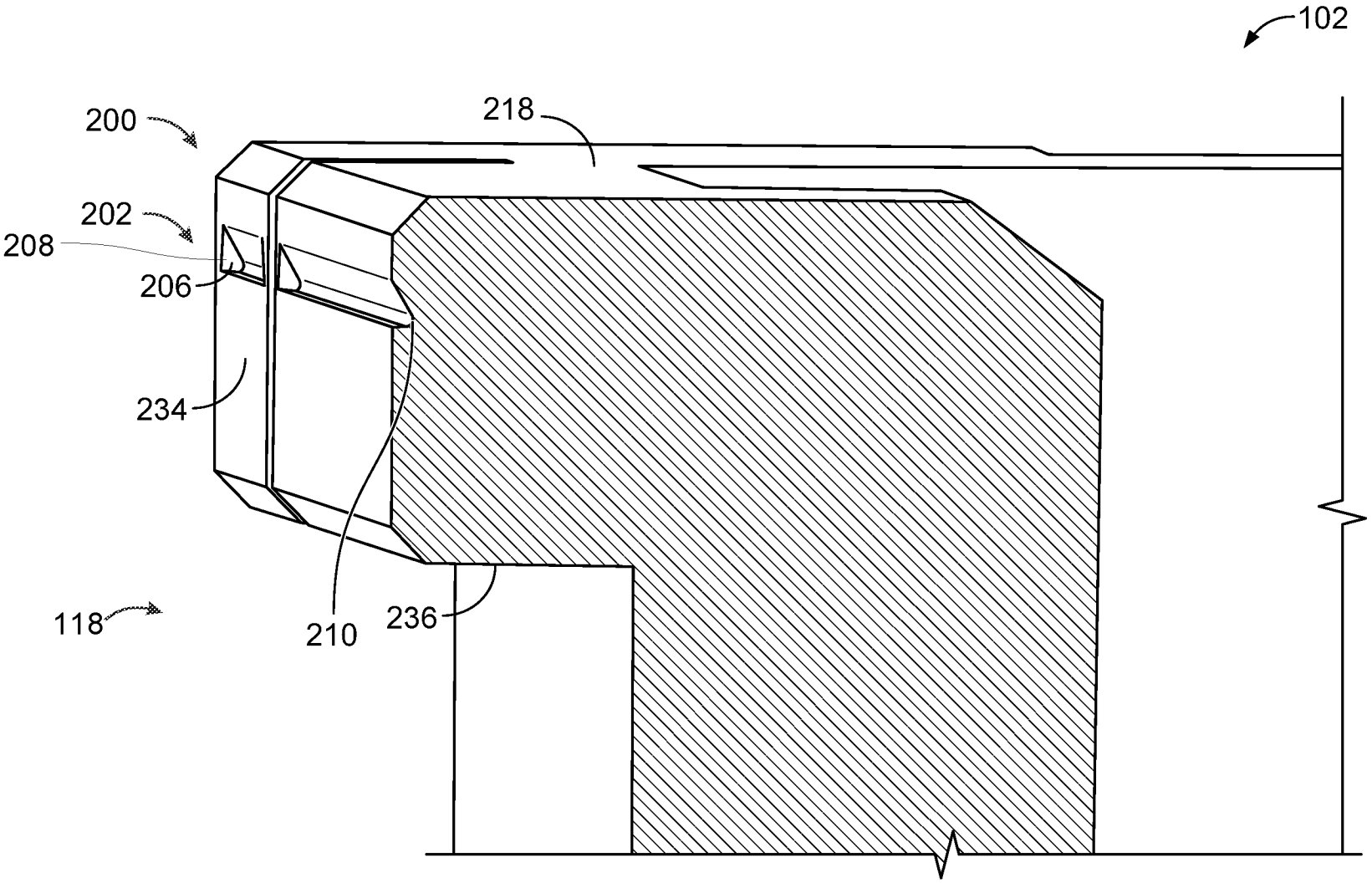
FIG. 2E depicts another perspective cross-section view of the example frame of FIG. 2A.
Figure 2F:
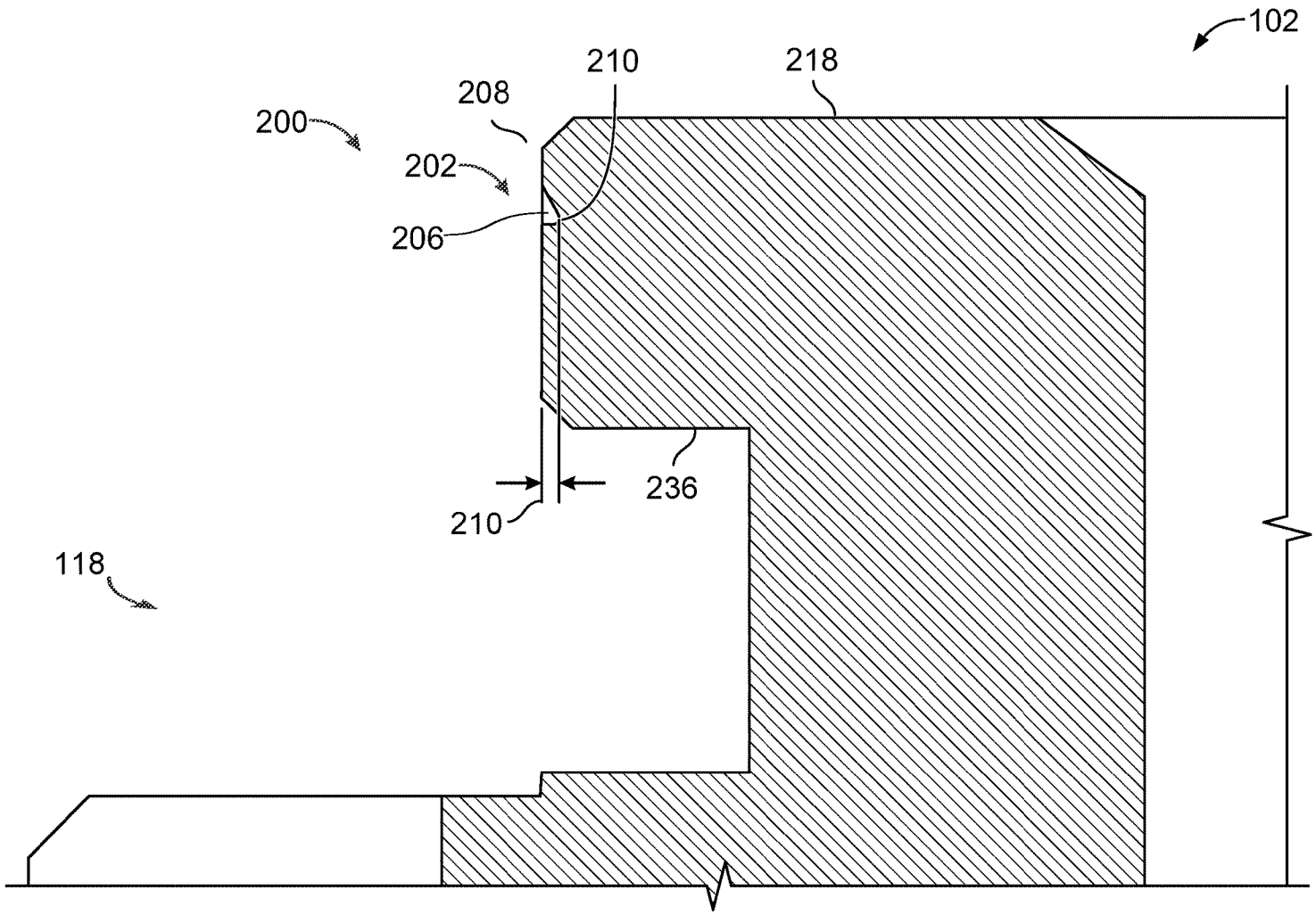
FIG. 2F depicts a front cross-section view of the example frame of FIG. 2A.
Figure 2G:
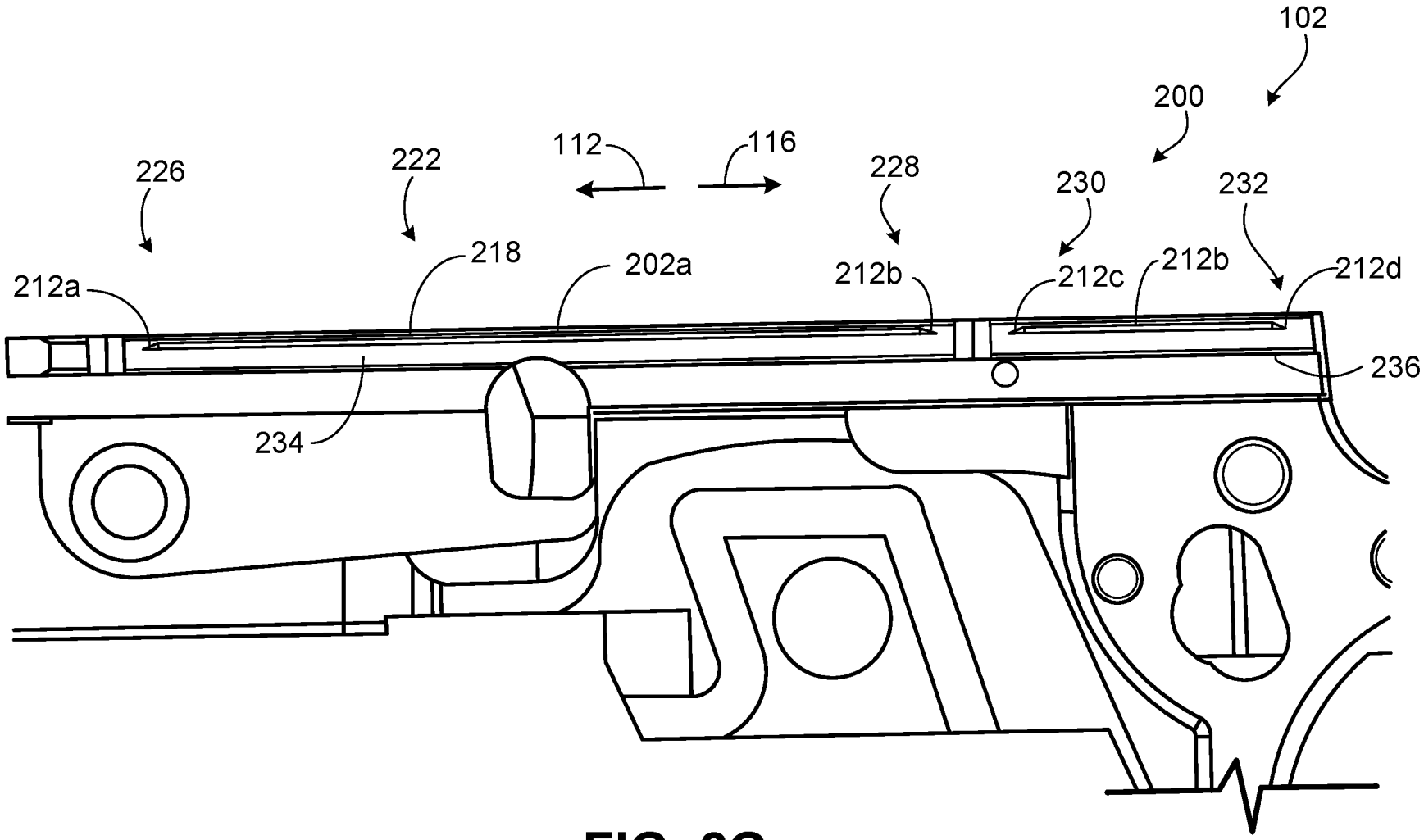
FIG. 2G depicts another side view of the example frame of FIG. 2A.
Figure 3A:
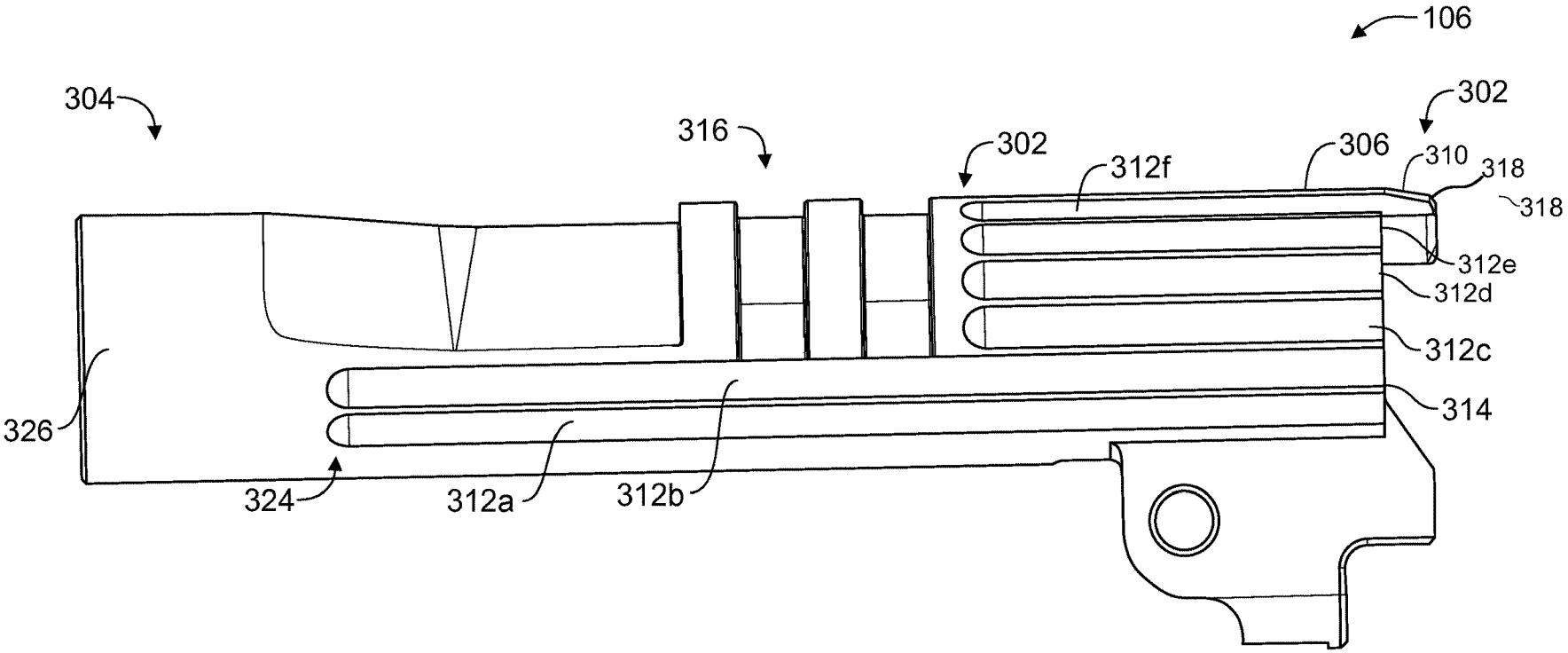
FIG. 3A depicts a side view of an example barrel of the example firearm of FIG. 1A.
Figure 3B:
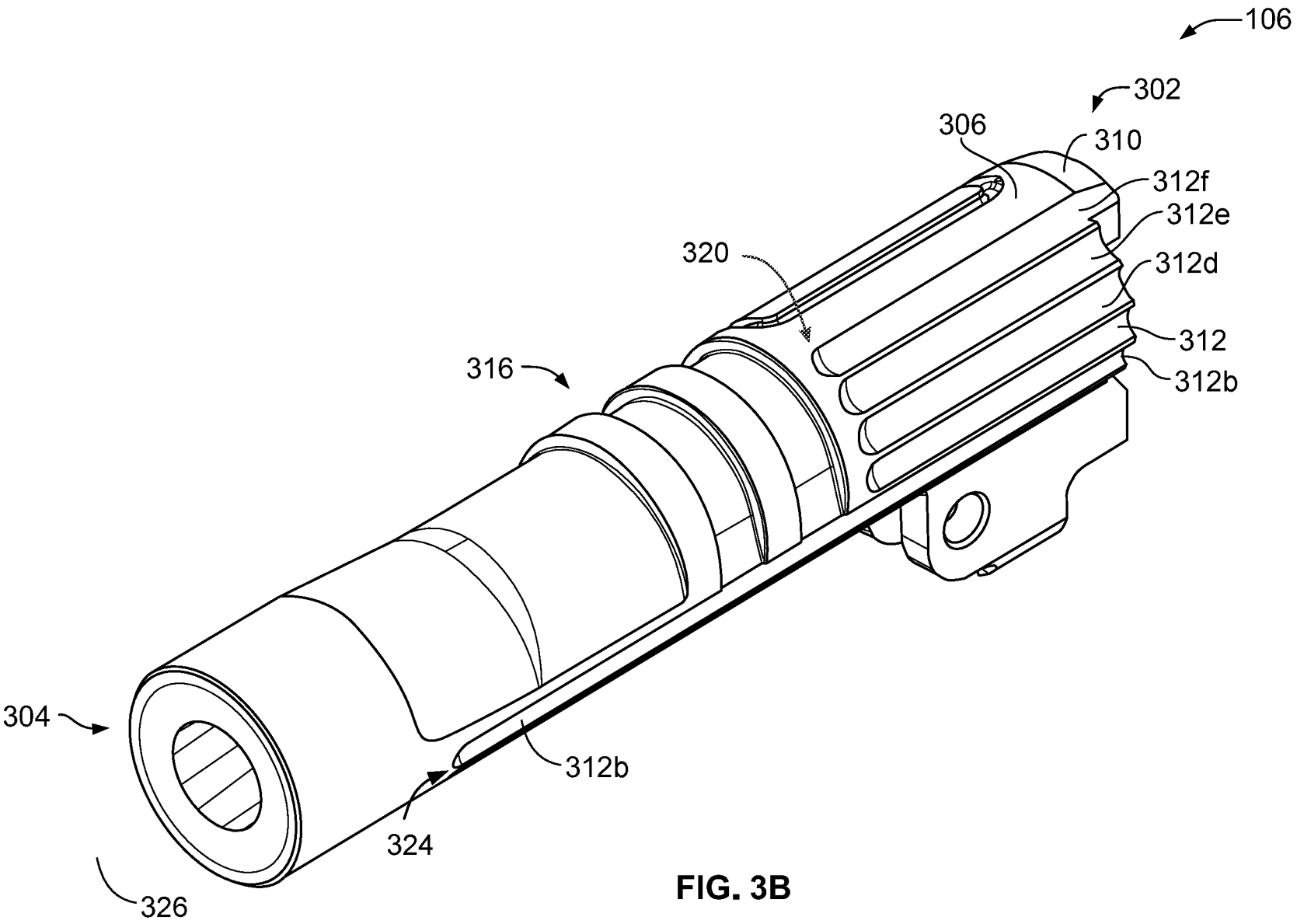
FIG. 3B depicts a perspective view of the example barrel of FIG. 3A.
Figure 3C:
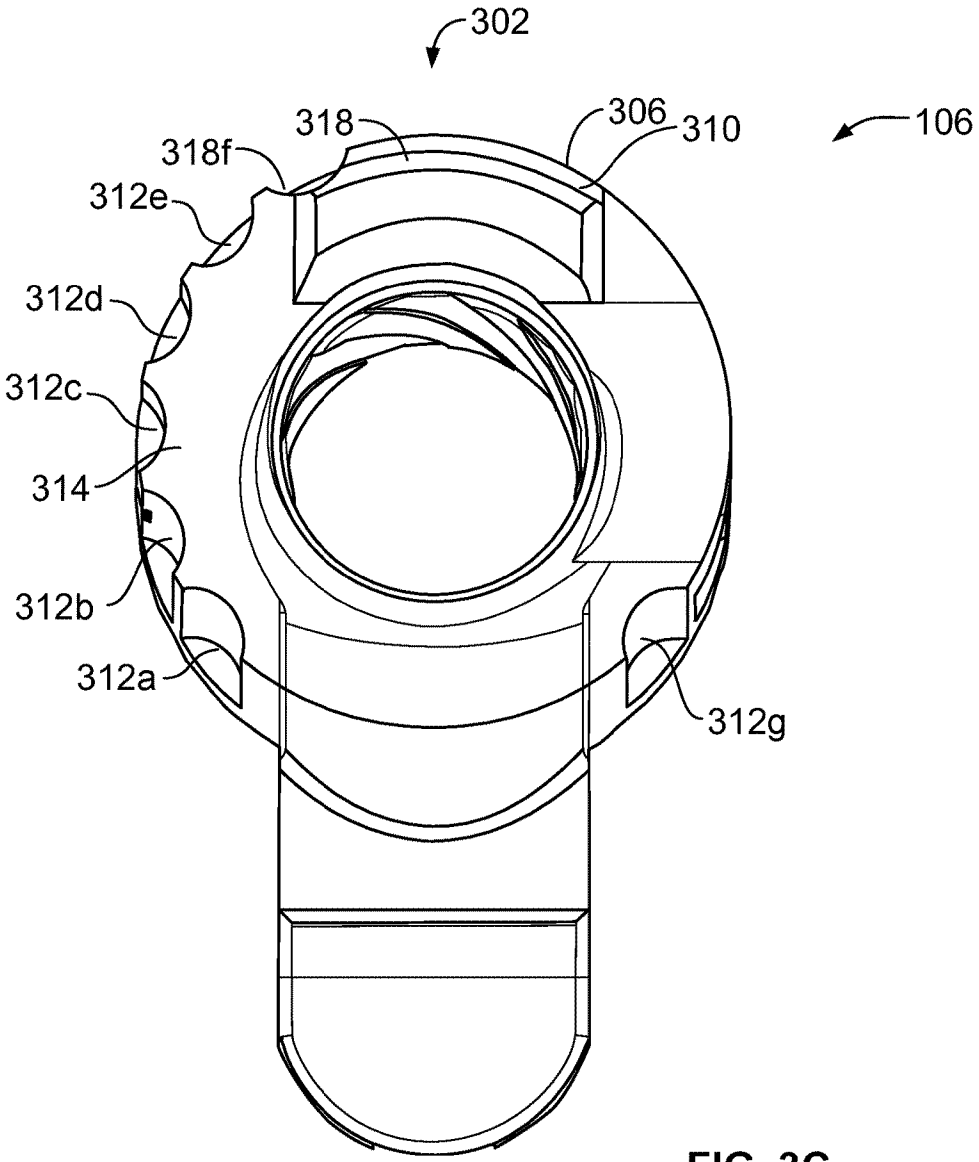
FIG. 3C depicts a rear view of the example barrel of FIG. 3A.
Figure 3D:
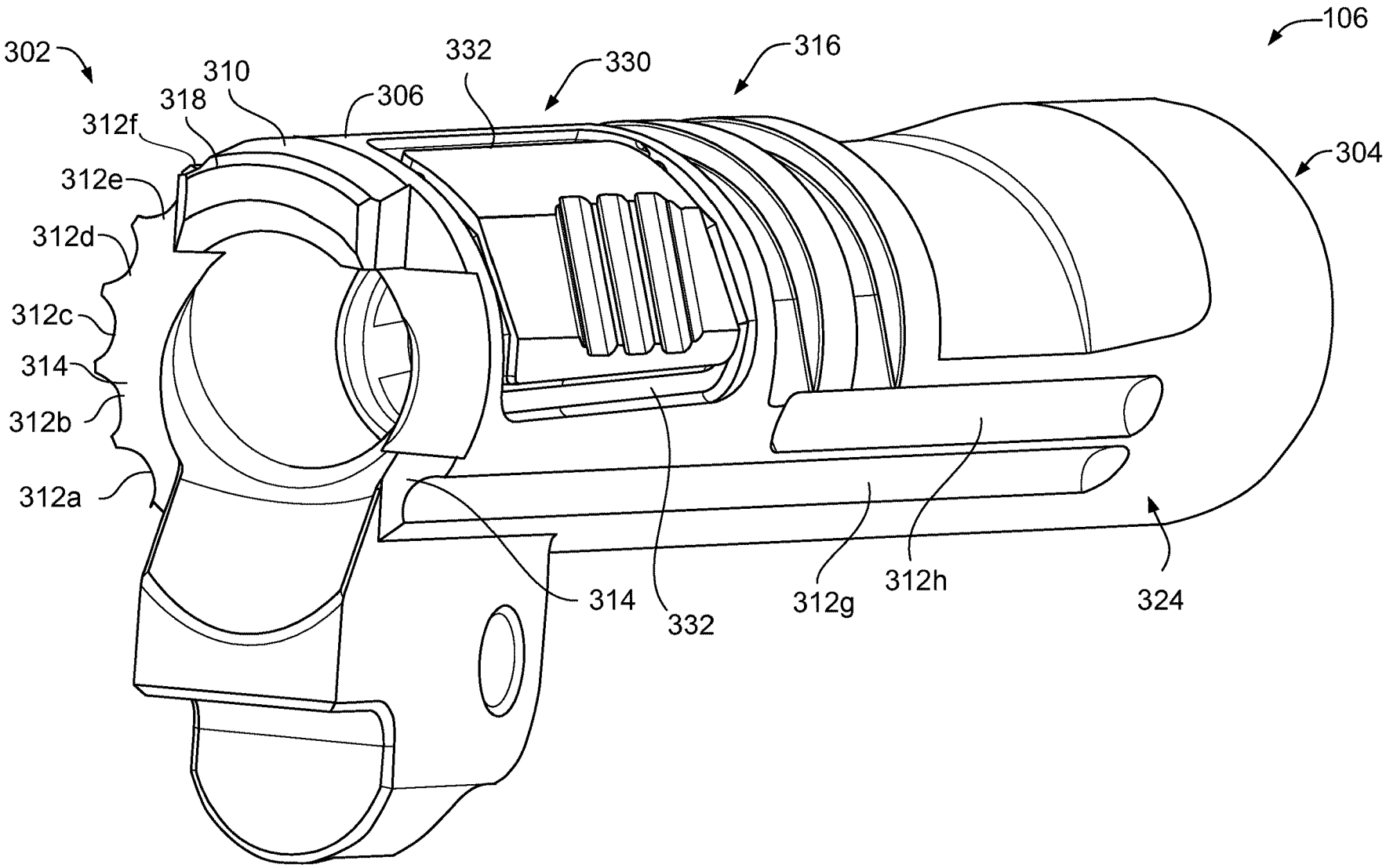
FIG. 3D depicts a rear perspective view of the example barrel of FIG. 3A.

As shown in FIGS. 2A, 2C, and 2D, the debris removal ports 204 are semi-circular shaped. However, in other implementations, the voids 204 can be square-shaped, rectangular, triangular, wedge-shaped, or any other geometric or non-geometric shape.

Referring to FIGS. 1A-1C and 3A-3D, the barrel 106 has a chamber end 302 and a muzzle end 304. The barrel 106 has an outer surface 306 extending between the chamber end 302 and the muzzle end 304 along a longitudinal axis 326. In operation, the rear surface 314 of the chamber end 302 interfaces with a breach surface 132 of the slide 104.

The barrel 106 has a barrel hood 310 extending from the rear surface 314 at the chamber end. In some implementations, the barrel hood 310 has a chamfered upper surface 318. In some implementations, the chamfered surface 318 tapers away from the outer surface 306 toward a center axis of the barrel 106. In some implementations, an angle 328 of the chamfered surface 318 relative to the outer surface 306 is between 5°-15°, e.g., approximately 10°.

The barrel 106 has flutings 312*a-h* extending along the outer surface 306 of the barrel 106. The flutings 312*a-h* transfer a quantity of heat from the barrel 106 to a space outside the barrel 106. FIGS. 6A-6G detail experimental data showing improved heat transfer and air circulation generated by the barrel fluting 312*a-h*.

Temperature measurements were taken at six locations on the firearm 100 during sustained firing. Measurements were conducted at location "A" on the rear of the frame rail 216, at location "B" on the front of the frame rail 216, at location "C" on the chamber end 302 of the barrel 106, at location "D" on the muzzle end 304 of the barrel 106, at location "E" on the frame 102 on the ejection port 130 side in near the breach surface 132, and at location "F" on the frame 102 on the opposite side from the ejection port 130.

Three tests were conducted. The first test was performed with a raw (unfluted and no coating) barrel. The second test was performed with a fluted barrel as described in reference to FIGS. 1A-1C and 3A-3D, but without the coating. The third test was performed with a barrel that was both fluted and coated with diamond-like carbon coating. As shown in FIG. 6G, the overall temperature measurements of the frame 102, slide 104, and barrel 106 were greatly reduced by the flutings 312*a-h* and the coating Some of the flutings, for example, flutings 312*a-g* extend from a rear face 314 of the barrel 106. The rear face 314 contacts breach surface 132 of the firearm 100 when the firearm 100 is operated. In other implementations, only one or at least one of flutings 312*a-g* extend from the rear face 314 of the barrel in the forward direction 112.

One fluting-fluting 312*h* is offset from the rear face 314. In other implementations, multiple flutings can be offset from the rear face 314. For example, fluting 312*h* begins in a region forward of the locking lugs 316 and terminates further down the barrel 106 towards the muzzle 304 end.

The barrel 106 has radial locking lugs 316 to engage the barrel 106 to the slide 104. The radial locking lugs 316 extend from the outer surface 306 of the barrel 106. The radial locking lugs 316 are positioned between the rear face 314 and a muzzle end 304 of the barrel 106. In some implementations, at least one fluting, for example, fluting, 312*b-f* terminates at a location 320 along the barrel 106 between the rear face 314 and radial locking lugs 316. In some implementations, another fluting, for example, flutings 312*a,b,g* extend along the barrel 106 from the rear face 314 past the radial locking lugs 316. In some implementations, another fluting 312*h* extend from a location 322 offset from the rear face 314 toward the muzzle end 304 and terminates at a location 324 offset from the radial locking lugs 316 toward the rear face 314.

The flutings 312*a-h* extend along the longitudinal axis 326. In some implementations, one or more of the flutings 312*a-h*, or even all the flutings 312*a-h* are parallel to the longitudinal axis of the barrel 106. In other implementations, one or more, or all of the flutings can be angled relative to the longitudinal axis 326 of the barrel 106.

A region of the barrel's outer surface 306 at the chamber end 302 can include additional fluting or grooves. For instance, an ejection port region 330 of the outer surface 306 can include a closed-loop groove 332 and vertical fluting. The ejection port region 330 is the region of the outer surface 306 that aligns with the ejection port 130 of the slide 104 when the firearm 100 is in battery (see e.g., FIG. 1C).

The barrel 106 can be covered by a coating. Some or all of the outer surface 306 can be covered by the coating. In some implementations, the coating can increase transfer of heat from the barrel 106. Alternatively or in addition, the coating can reduce a friction coefficient of the barrel, increase a wear resistance of the barrel 106, or improve a surface finish of the barrel 106. For example, the coating can be a diamond-like carbon coating.

Referring to FIG. 4, the slides outer surface 402 is machined for form a planar top surface 404 offset from the rest of the outer surface 402. The planar top surface 404 can extend from the first side 222 to the second side 224. The planar top surface 404 forms a mounting site for the cover plate 126 depicted in FIGS. 1A-1D. For example, the cover plate 126 can form a base for an iron sight 128 or an optical sight such as a red dot or other optic assembly.

The slide 104 has weight reduction cuts 406 extending from the planar top surface 404 of the slide 104. In some implementations, the weight reduction cuts 406 extend to a bottom surface 408 of the slide 104. The weight reduction cuts 406 can have different shapes, sizes, and depths. The planar top surface 404 of the slide 104 can be covered by the optic assembly, covering one or more of the weight reduction cuts. In some implementations, the weight reduction cuts expose some of the internal components of the slide. For example, in FIG. 4, the center weight reduction cut 406 exposes the firing pin spring 410.

Referring to FIGS. 1A-1C and 5A-5C, the trigger 110 has a rear surface 502 facing the rearward direction 116 and a front surface 518 facing the forward direction 112. The operator imparts a force to the front surface 518 of the trigger 110 in the rearward direction 116, moving the trigger 110 in the rearward direction 116 to fire the firearm 100. The trigger 110 has a boss 504 extending from the rear surface 502. The boss 504 can limit travel of the trigger 110 when the trigger 110 is actuated by an operator. More specifically, the boss 504 can limit motion in the rearward direction 116 of the trigger 110 after a sear 122 releases a hammer 124.

The rear surface 502 has a first portion 524 and a second portion 526. The first portion 524 is offset from the second portion in the forward direction 112. The boss 504 extends from the first portion 524 in the rearward direction 116 by a height 510 of the boss 504.

The boss 504 has a top surface 506 at the height 510. The top surface 506 of the boss 504 is offset from the second portion 526 by an offset dimension 512.

The boss 504 has side surfaces 520, 522. The side surfaces 520, 522 connect the top surface 506 to the first portion 524.

As used herein, the term "semiautomatic firearm" refers to a firearm which automatically extracts a spent cartridge casing and chambers a new round after each shot. The semiautomatic firearm uses a portion of the energy from a firing round to extract a spent cartridge casing from the fired round, cock the firearm, and chamber a new round with each pull of the trigger, but requires a separate pull of the trigger to fire the new round.

As used herein, the term "non-semiautomatic firearm" refers to a firearm which requires a user to manually manipulate some mechanism of the firearm to chamber a new round after each shot.

As used herein, the term "automatic firearm" refers to a firearm which automatically extracts a spent cartridge casing, chambers a new round after each shot, and fires the new round in a repeating fashion with a single pull of the trigger.

In an automatic firearm, this process repeats until the trigger is released or all of the ammunition in the firearm is expended.

As used herein, the terms "orthogonal" or "substantially orthogonal" refer to a relation between two elements (e.g., lines, axes, planes, surfaces, or components) that forms a ninety-degree (perpendicular) angle within acceptable engineering, machining, or measurement tolerances. For example, two surfaces can be considered orthogonal to each other if the angle between the surfaces is within an acceptable tolerance of ninety degrees (e.g., +1-2 degrees).

As used herein, the terms "aligned," "substantially aligned," "parallel," or "substantially parallel" refer to a relation between two elements (e.g., lines, axes, planes, surfaces, or components) as being oriented generally along the same direction within acceptable engineering, machining, drawing measurement, or part size tolerances such that the elements do not intersect or intersect at a minimal angle. For example, two surfaces can be considered aligned with each other if surfaces extend along the same general direction of a device.

As used herein, the term "recoil forces" refers forces exerted on various components of a firearm (e.g., breech face, slide, frame, recoil spring) which balance the forward momentum of a projectile being discarded from the firearm. Recoil forces are generally experienced directly at the breach face and transmitted through the breach face to other components of the firearm.

As used herein, terms describing relative directions or orientations (e.g., front, back/rear, distal, proximate, top/upper, bottom/lower) of various elements are used in reference to the perspective of a user holding a firearm. Thus, for example, the distal/front edge or surface of a component refers to that edge or surface of the component that is nearest or facing the muzzle of the firearm when the component properly installed in the firearm. Similarly, for example, the back/proximate edge or surface of a component refers to that edge or surface of the component that is farthest from or facing away from the muzzle of the firearm when the component is properly installed in the firearm. Likewise, for example, the top/upper edge or surface of a component refers to that edge or surface of the component that is nearest or facing the top of the firearm when the component is properly installed in the firearm and the firearm is held in a normal firing position. Finally, for example, the bottom/lower edge or surface of a component refers to that edge or surface of the component that is nearest or facing the bottom of the firearm when the component is properly installed in the firearm and the firearm is held in a normal firing position.

While a number of examples have been described for illustration purposes, the foregoing description is not intended to limit the scope of the invention, which is defined by the scope of the appended claims. There are and will be other examples and modifications within the scope of the following claims.

What is claimed is:

1. A firearm comprising:

a slide comprising a slide rail; and a frame comprising a frame rail configured to extend into a recess of the slide rail, the frame rail comprising:

a lubrication groove extending along a surface of the frame rail that bears against a corresponding surface of the recess of the slide rail during operation of the firearm, wherein the lubrication groove extends substantially along an entire length of the frame rail; and a debris removal port comprising a gap within the frame rail proximate to an end of the lubrication groove.

2. The firearm of claim 1, wherein a lubricating oil positioned in the groove contacts a surface of the slide rail.

3. The firearm of claim 2, wherein responsive to motion of the slide relative to the frame, the lubricating oil wicks from the lubrication groove to the surface of the slide rail.

4. The firearm of claim 1, wherein the lubrication groove comprises:

a first tapered portion extending from a first end of the groove to the surface of the frame; and a second tapered portion extending from a second end of the groove opposite the first end to the surface of the frame.

5. The firearm of claim 1, wherein the lubrication groove comprises a wicking material disposed within the groove.

6. The firearm of claim 1, wherein the frame rail comprises a first segment and a second segment separated by the debris removal port, wherein the lubrication groove is located on the first segment, and wherein the second segment comprises a second lubrication groove, that is substantially aligned with the lubrication groove.

7. The firearm of claim 1, wherein the debris removal port is a first debris removal port located proximate to a first end of the lubrication groove and the frame rail comprises a second debris removal port located proximate to a second end of the lubrication groove.

8. The firearm of claim 1, wherein the debris removal port comprises a semi- circular gap extending from a top surface to a bottom surface of the frame rail.

9. The firearm of claim 1, further comprising a barrel disposed within the slide, the barrel comprising a plurality of flutings extending along a portion of an outer surface of the barrel.

10. The firearm of claim 9, wherein the barrel comprises a rear surface that engages with a breach surface of the slide and at least one of the flutings extends through the rear surface forming a semi-circular profile with the rear surface.

11. The firearm of claim 10, wherein the at least one of the flutings terminates rearward of a locking lug located on an upper portion of the outer surface of the barrel.

12. The firearm of claim 10, wherein the at least one of the flutings extends past a locking lug located on an upper surface of the barrel.

13. The firearm of claim 9, wherein the barrel comprises a barrel hood with a chamfered upper surface.

14. The firearm of claim 9, wherein the barrel comprises an ejection port region on the outer surface of the barrel that aligns with an ejection port of the slide, with the slide in a battery position, wherein the ejection port region comprises a closed-loop concave groove within the outer surface of the barrel.

15. The firearm of claim 1, wherein the slide comprises:

a region on an upper surface of the slide that is formed into a generally planar surface configured to mate with a cover plate, the generally planar surface comprising at least one weight reduction cut extending below the generally planar surface.

16. The firearm of claim 15, wherein the at least one weight reduction cut exposes a firing pin spring within the slide.

17. The firearm of claim 16, wherein the at least one weight reduction cut extends from the generally planar surface through to a bottom interior surface of the slide.

18. The firearm of claim 1, comprising a trigger installed within the frame, wherein the trigger comprises a boss extending from a front trigger surface, wherein the boss engages with an internal surface of the frame to form a trigger over-travel stop.

19. A frame for a firearm comprising:

a frame rail configured to extend into a recess of a slide rail of a firearm slide with the slide attached, the frame rail comprising:

a lubrication groove extending along a surface of the frame rail that bears against a corresponding surface of the recess of the slide rail during operation of the firearm, wherein the lubrication groove extends substantially along an entire length of the frame rail; and a debris removal port comprising a gap within the frame rail proximate to an end of the lubrication groove.

* * * * *